US011454448B2

(12) United States Patent
Fukada et al.

(10) Patent No.: US 11,454,448 B2
(45) Date of Patent: Sep. 27, 2022

(54) ENHANCED HEAT TRANSFER SURFACE

(71) Applicant: DANA CANADA CORPORATION, Oakville (CA)

(72) Inventors: Takayuki Fukada, Mississauga (CA); Michael J. R. Bardeleben, Oakville (CA); Benjamin A. Kenney, Toronto (CA)

(73) Assignee: Dana Canada Corporation, Oakville (CA)

( * ) Notice: Subject to any disclaimer, the term of this patent is extended or adjusted under 35 U.S.C. 154(b) by 274 days.

(21) Appl. No.: 16/767,022

(22) PCT Filed: Nov. 27, 2018

(86) PCT No.: PCT/CA2018/051505
§ 371 (c)(1),
(2) Date: May 26, 2020

(87) PCT Pub. No.: WO2019/100170
PCT Pub. Date: May 31, 2019

(65) Prior Publication Data

US 2020/0370834 A1 Nov. 26, 2020

Related U.S. Application Data

(60) Provisional application No. 62/590,963, filed on Nov. 27, 2017, provisional application No. 62/590,997, filed on Nov. 27, 2017.

(51) Int. Cl.
*F28D 1/03* (2006.01)
*F28F 3/02* (2006.01)

(52) U.S. Cl.
CPC ..... *F28D 1/0341* (2013.01); *F28F 3/027* (2013.01)

(58) Field of Classification Search
CPC .... F28D 1/0341; F28D 1/0308; F28D 9/0006; F28D 9/0025; F28D 9/0031;
(Continued)

(56) References Cited

U.S. PATENT DOCUMENTS 1,318,012 A * 10/1919 Schlacks ..... F28F 3/04 165/DIG. 381
1,416,570 A 5/1922 Modine
(Continued)

FOREIGN PATENT DOCUMENTS

CN 1858542 A 11/2006
CN 205607214 U 9/2016
(Continued)

OTHER PUBLICATIONS

Office Action; CN Application No. 20180076759.4 dated Jul. 16, 2021.
(Continued)

*Primary Examiner* — Justin M Jonaitis
(74) *Attorney, Agent, or Firm* — Ridout & Maybee LLP

(57) ABSTRACT

A heat transfer surface for use in conjunction with a heat exchanger is disclosed. The heat transfer surface a corrugated member where rows of corrugations that are offset relative to each other forming at least an alternating series of first and second rows or first, second and third rows. In some embodiments the heat transfer surface includes a heat transfer enhancement feature disposed within individual corrugations of the corrugated member to provide a more turbulent or tortuous fluid flow path through the heat transfer surface. In some example embodiments the heat transfer enhancement feature is a ridge disposed in the planar portions of at least some of the rows of corrugations. In other example embodiments the planar fin portions are porous fin surfaces. In other embodiments, the corrugated member
(Continued)

cooperates with heat transfer enhancement features in the form of triangular protuberances disposed on their inner surfaces of spaced apart plates.

16 Claims, 15 Drawing Sheets

(58) Field of Classification Search
CPC .... F28D 9/0037; F28D 9/0062; F28D 9/0081; F28F 3/027; F28F 3/02; F28F 3/08; F28F 3/083; F28F 1/40; F01N 3/0205
See application file for complete search history.

(56) References Cited

U.S. PATENT DOCUMENTS 1,458,128 A 6/1923 Curran
1,557,467 A 10/1925 Modine
2,360,123 A * 10/1944 Gerstung ..... F28D 9/0012 165/166
2,963,277 A * 12/1960 Heller ..... F28F 1/32 165/151
2,990,163 A * 6/1961 Farrell ..... F28F 13/12 29/896.6
3,016,921 A * 1/1962 Alberto ..... F28F 3/027 138/42
3,045,979 A * 7/1962 Huggins ..... B21D 53/08 29/890.03
3,083,662 A * 4/1963 Zeidler ..... B21D 53/02 428/596
3,768,149 A * 10/1973 Swaney, Jr. ..... F28F 3/027 72/47
3,804,159 A * 4/1974 Searight ..... F28F 1/128 165/181
3,887,664 A 6/1975 Regehr
4,300,629 A * 11/1981 Hatada ..... F28F 1/325 165/151
4,593,756 A * 6/1986 Itoh ..... F28F 1/325 165/151
4,727,907 A 3/1988 Duncan
4,787,442 A 11/1988 Esformes
4,804,041 A * 2/1989 Hasegawa ..... F28F 3/027 165/166
4,821,795 A * 4/1989 Lu ..... F28F 1/325 165/181
4,844,151 A * 7/1989 Cohen ..... F28D 9/0068 165/44
4,860,822 A * 8/1989 Sacks ..... F28F 1/325 165/181
4,869,316 A * 9/1989 Yoshida ..... F28F 1/325 165/170
4,899,812 A * 2/1990 Altoz ..... F28F 13/12 165/46
4,984,626 A 1/1991 Esformes et al.
5,009,263 A * 4/1991 Seshimo ..... F28F 1/20 165/181
5,056,594 A * 10/1991 Kraay ..... F28F 1/325 165/181
5,107,922 A * 4/1992 So ..... F28F 3/027 165/154
5,114,776 A 5/1992 Cesaroni
5,184,672 A * 2/1993 Aoki ..... F28F 13/12 138/38
5,209,289 A * 5/1993 Haushalter ..... F28F 13/12 165/166
5,295,302 A * 3/1994 Takai ..... B21C 37/14 228/183
5,375,655 A 12/1994 Lee
5,625,229 A * 4/1997 Kojima ..... H01L 23/3672 257/722
6,273,183 B1 * 8/2001 So ..... F28D 1/0333 165/152
6,415,855 B2 7/2002 Gerard et al.
6,615,910 B1 * 9/2003 Joshi ..... F28F 3/02 257/722
6,729,388 B2 * 5/2004 Emrich ..... F28D 1/05366 165/181
6,901,995 B2 * 6/2005 Yamaguchi ..... B21D 31/046 165/173
6,976,529 B2 * 12/2005 Kester ..... F28F 1/325 62/515
7,059,397 B2 6/2006 Chatel et al.
7,267,163 B2 * 9/2007 Osakabe ..... F28D 9/0056 165/166
7,290,595 B2 * 11/2007 Morishita ..... F28F 3/027 165/109.1
7,303,002 B2 * 12/2007 Usui ..... F28D 7/1684 165/109.1
7,686,070 B2 * 3/2010 Chu ..... F28F 3/025 165/170
8,151,617 B2 * 4/2012 Feng ..... B21D 53/04 72/379.6
8,418,752 B2 * 4/2013 Otahal ..... B21D 53/02 165/166
8,424,592 B2 4/2013 Meshenky
8,453,719 B2 * 6/2013 Sperandei ..... F28F 3/027 165/181
8,561,451 B2 * 10/2013 Opferkuch ..... F28F 3/046 72/379.6
9,689,628 B2 6/2017 Uno et al.
9,945,619 B2 * 4/2018 Cho ..... F28F 3/025
9,958,215 B2 * 5/2018 Buckrell ..... F28F 1/128
10,048,019 B2 * 8/2018 Karlen ..... F28F 3/022
10,048,020 B2 * 8/2018 Sperandei ..... F28F 13/12
10,107,553 B2 10/2018 Takagi et al.
2001/0054499 A1 12/2001 Gerard et al.
2002/0074109 A1 6/2002 Rhodes et al.
2004/0099408 A1 * 5/2004 Shabtay ..... F28F 3/027 165/177
2005/0015700 A1 * 1/2005 Hetzler ..... G06F 11/1076 714/766
2006/0016582 A1 1/2006 Hashimoto et al.
2006/0243429 A1 * 11/2006 Chu ..... F28F 3/025 165/177
2006/0243431 A1 11/2006 Martin et al.
2008/0202731 A1 8/2008 Brunner et al.
2012/0193077 A1 8/2012 Choi
2013/0167584 A1 7/2013 Sunder et al.
2013/0277030 A1 10/2013 Wang
2015/0121701 A1 5/2015 Loong et al.
2016/0069623 A1 * 3/2016 Iwasaki ..... F02M 26/32 165/167
2016/0209132 A1 7/2016 Mironets
2016/0290733 A1 10/2016 Noishiki et al.
2017/0107883 A1 * 4/2017 Kuroyanagi ..... F28F 1/40
2017/0307309 A1 10/2017 Negi et al.
2018/0195424 A1 7/2018 Semura et al.

FOREIGN PATENT DOCUMENTS

JP 60194290 A 10/1985
WO WO2003010481 A1 7/2002
WO 2011158329 A1 12/2011
WO WO-2011158329 A1 * 12/2011 ..... B21D 13/02
WO 2017059959 4/2017

OTHER PUBLICATIONS

International Search Report and Written Opinion; PCT/CA2018/051505; dated Feb. 9, 2019.

* cited by examiner

Heat Transfer and Friction Factor Correlation Comparison
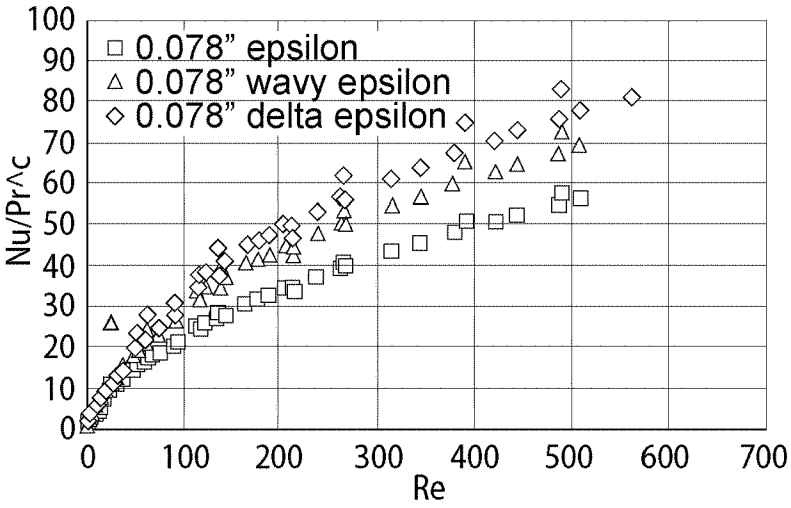
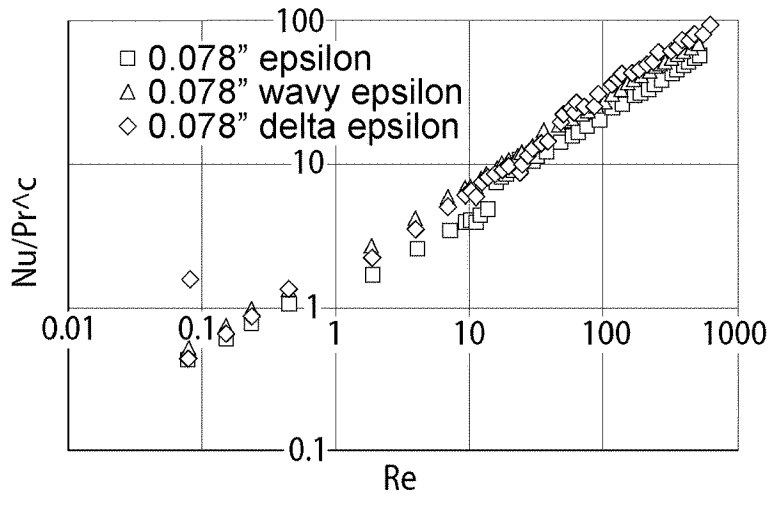
| | 0.078" epsilon | 0.078" wavy epsilon | 0.078" delta epsilon | Best turb |
|---|---|---|---|---|
| Average Heat transfer comparison: Nu/Pr0.41 | | | | |
| 1 < Re < 100 | 11.1 | 14.4 | 14.4 | delta epsilon = wavy epsilon |
| Re < 100 | 40.6 | 51.7 | 58.1 | delta epsilon |
| Darcy friction factor comparison: f | | | | |
| 1 < Re < 100 | 25.9 | 25.2 | 30.0 | wavy epsilon |
| Re > 100 | 17.3 | 16.2 | 19.0 | wavy epsilon |
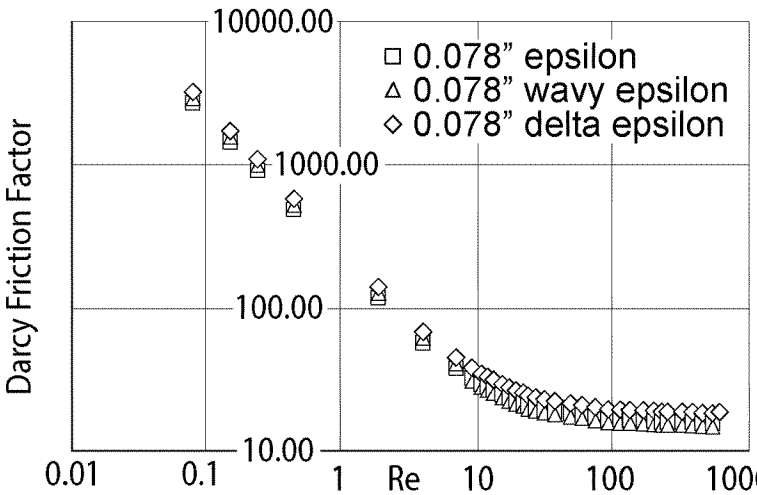
FIG. 14

Heat Exchanger Calculations

| | | | | | |
|---|---|---|---|---|---|
| **fluid** | Glycol 60% | **flow rate** | 40LPM | **inlet temperature** | 100°C |
| **fluid** | Pentosin FFL-4 | **flow rate** | 70LPM | **inlet temperature** | 125°C |

| Turb | Cold Side | | | Hot Side | | | Cooler | |
|---|---|---|---|---|---|---|---|---|
| | ΔP kPa | Tout °C | Bypass % | ΔP kPa | Tout °C | Bypass % | Q kW | ε % |
| 0.078" epsilon | 53.1 | 114.4 | 16.7% | 129.2 | 108.3 | 16.7% | 34.3 | 80.7% |
| 0.078" wavy epsilon | 50.3 | 115.3 | 16.2% | 121.1 | 107.2 | 16.1% | 36.5 | 85.5% |
| 0.078" delta epsilon | 57.3 | 115.3 | 17.3% | 142.5 | 107.2 | 17.6% | 36.4 | 86.8% |

note: pressure drop reported in this table are for the channel only, not including the fittings & headers

FIG. 15 y
233
210
x
231
y
x
212
224
220
224
235
220
235
224
220
235
220
235
220
235
220
235
220
235
230
222
230
235
222
230
235
222
230
235

ENHANCED HEAT TRANSFER SURFACE

CROSS-REFERENCE TO RELATED APPLICATIONS

This application claims priority to and the benefit of U.S. Provisional Patent Application No. 62/590,963 filed Nov. 27, 2017 and U.S. Provisional Patent Application No. 62/590,997 filed Nov. 27, 2017, the contents of which applications are incorporated herein by reference in their entirety.

FIELD

The invention relates to heat exchangers, and in particular, to heat transfer surfaces in the form of turbulizers used to increase or enhance heat transfer performance in heat exchangers.

BACKGROUND

In heat exchangers, particularly of the type used to heat or cool fluids, it is common to use heat transfer surfaces, often referred to as turbulizers, that are positioned either inside or outside the fluid flow passages of the heat exchanger to increase and/or enhance overall heat transfer performance of the heat exchanger. Various types of heat transfer surfaces, or turbulizers, are known. One common type of heat transfer surface is a corrugated member consisting of sinusoidal or rectangular corrugations extending in rows along the length or width of the heat exchanger plates or tubes. The corrugated member may also be provided with a series of "slits" or "louvers" formed in the planar surfaces of the corrugated member with the slits or louvers serving to disrupt boundary layer growth along the length of the planar surfaces and increase mixing in the fluid flowing over/through the heat transfer surface in an effort to increase overall heat transfer performance of the heat exchanger.

While positioning a heat transfer surface within the fluid flow channels of a heat exchanger increases or enhances overall heat transfer performance by providing additional surface area for heat transfer, heat transfer surfaces are also known to increase pressure drop through the fluid channel in which the heat transfer surface is located. Therefore, there is a continual need to provide improved or enhanced heat transfer surfaces that provide the benefit of increased or improved heat transfer performance without having an undue negative impact on the overall pressure drop across the heat transfer surface which, in turn, can negatively impact heat transfer performance of the heat exchanger.

SUMMARY

In accordance with an example embodiment of the present disclosure, there is provided a heat transfer surface, comprising a plurality of transverse rows of corrugations disposed adjacent to one another and extending in an axial direction; wherein each row includes a plurality of spaced apart upper and lower bridge portions; and a plurality of fin surface portions extending between and interconnecting the spaced apart upper and lower bridge portions; wherein the plurality of spaced apart upper and lower bridge portions and the plurality of fin surface portions are co-operatively configured such that an alternating series of upper and lower bridge portions interconnected by fin surface portions is formed; the plurality of rows of corrugations includes at least a first row and at least a second row together defining at least one pair of adjacent rows of corrugations; for each one of the at least one pair of adjacent rows of corrugations, the first row is offset relative to the second row such that the corrugations in the first row partially overlap the corrugations in the adjacent second row; wherein the heat transfer surface further comprises: a heat transfer enhancement feature disposed in the fin surface portions such that the heat transfer enhancement feature is disposed intermediate adjacent upper and lower bridge portions in the alternating series of upper and lower bridge portions; wherein at least one of the rows of the at least one pair of rows includes the heat transfer enhancement feature.

According to another example embodiment of the present disclosure there is provided a heat transfer surface, comprising: a plurality of transverse rows of corrugations disposed adjacent to one another and extending in an axial direction; wherein each row includes: a plurality of spaced apart upper and lower bridge portions; and a plurality of fin surface portions extending between and interconnecting the spaced apart upper and lower bridge portions; wherein the plurality of spaced apart upper and lower bridge portions and the plurality of fin surface portions are co-operatively configured such that an alternating series of upper and lower bridge portions interconnected by fin surface portions is formed; the plurality of rows of corrugations includes at least a first row, at least a second row and at least a third row together defining at least one set of adjacent rows of corrugations; wherein for each set of adjacent rows of corrugations, the first row is offset relative to the second row and the second row is offset relative to the third row such that the corrugations in the first row partially overlap the corrugations in the adjacent second row and the corrugations in the second row partially overlap the corrugations in the third row.

According to another example embodiment of the present disclosure there is provided heat exchanger comprising: a plurality of tubular members disposed in spaced apart, parallel, or substantially parallel, relationship to one another; a plurality of first fluid channels defined by the plurality of tubular members, each tubular member having spaced apart first and second walls such that first fluid channel extends through each of the tubular members between the space apart first and second walls; a plurality of second fluid channels defined between adjacent tubular members; wherein the plurality of tubular members are co-operatively configured such that the first fluid channels are fluidly interconnected defining an inlet manifold for inletting a heat exchange fluid into the plurality of first fluid channels and defining an outlet manifold for discharging the heat exchange fluid from the plurality of first fluid channels; a heat transfer surface disposed within each of the plurality of first fluid channels, wherein the heat transfer surface comprises: a plurality of transverse rows of corrugations disposed adjacent to one another and extending in an axial direction; wherein each row includes: a plurality of spaced apart upper and lower bridge portions; and a plurality of fin surface portions extending between and interconnecting the spaced apart upper and lower bridge portions; wherein the plurality of spaced apart upper and lower bridge portions and the plurality of fin surface portions are co-operatively configured such that an alternating series of upper and lower bridge portions interconnected by fin surface portions is formed; the plurality of rows of corrugations includes at least a first row and at least a second row together defining at least one pair of adjacent rows of corrugations; for each one of the at least one pair of adjacent rows of corrugations, the first row is offset relative to the second row such that the corrugations in the first row partially overlap the corrugations in the adjacent second row; wherein the heat transfer surface further comprises: a heat transfer enhancement feature disposed in the fin surface portions such that the heat transfer enhancement feature is disposed intermediate adjacent upper and lower bridge portions in the alternating series of upper and lower bridge portions; wherein at least one of the rows of the at least one pair of rows includes the heat transfer enhancement feature.

According to yet another example embodiment of the present disclosure there is provided a heat exchanger comprising: a plurality of tubular members disposed in spaced apart, parallel, or substantially parallel, relationship to one another; a plurality of first fluid channels defined by the plurality of tubular members, each tubular member having spaced apart first and second walls such that first fluid channel extends through each of the tubular members between the space apart first and second walls; a plurality of second fluid channels defined between adjacent tubular members; wherein the plurality of tubular members are co-operatively configured such that the first fluid channels are fluidly interconnected defining an inlet manifold for inletting a heat exchange fluid into the plurality of first fluid channels and defining an outlet manifold for discharging the heat exchange fluid from the plurality of first fluid channels; a heat transfer surface disposed within each of the plurality of first fluid channels, wherein the heat transfer surface comprises: a plurality of transverse rows of corrugations disposed adjacent to one another and extending in an axial direction; wherein each row includes: a plurality of spaced apart upper and lower bridge portions; and a plurality of fin surface portions extending between and interconnecting the spaced apart upper and lower bridge portions; wherein the plurality of spaced apart upper and lower bridge portions and the plurality of fin surface portions are co-operatively configured such that an alternating series of upper and lower bridge portions interconnected by fin surface portions is formed; the plurality of rows of corrugations includes at least a first row, at least a second row and at least a third row together defining at least one set of adjacent rows of corrugations; wherein for each set of adjacent rows of corrugations, the first row is offset relative to the second row and the second row is offset relative to the third row such that the corrugations in the first row partially overlap the corrugations in the adjacent second row and the corrugations in the second row partially overlap the corrugations in the third row.

In accordance with another example embodiment of the present disclosure, there is provided heat transfer surface, comprising a pair of first and second spaced apart plates each defining an inner surface; a corrugated member disposed between the spaced apart first and second plates, the corrugated member including a plurality of transverse rows of corrugations disposed adjacent to one another and extending in an axial direction; wherein each row includes: a plurality of spaced apart upper and lower bridge portions; and a plurality of fin surface portions extending between and interconnecting the spaced apart upper and lower bridge portions; wherein the plurality of spaced apart upper and lower bridge portions and the plurality of fin surface portions are co-operatively configured such that an alternating series of upper and lower bridge portions interconnected by fin surface portions is formed defining a plurality of heat transfer enhancement-receiving spaces; the plurality of rows of corrugations includes at least a first row and at least a second row together defining at least one pair of adjacent rows of corrugations; for each one of the at least one pair of adjacent rows of corrugations, the first row is offset relative to the second row such that the corrugations in the first row partially overlap the corrugations in the adjacent second row; a plurality of heat transfer enhancement features disposed on the inner surfaces of the first and second spaced apart plates such that one of the plurality of heat transfer enhancement features is disposed in each heat transfer enhancement-receiving spaced defined by the alternating series of upper and lower bridge portions interconnected by fin surface portions of each row of corrugations.

In accordance with another example embodiment of the present disclosure, there is provided heat exchanger, comprising: a plurality of tubular members disposed in spaced apart, parallel, or substantially parallel, relationship to one another; a plurality of first fluid channels defined by the plurality of tubular members, each tubular member having spaced apart first and second walls such that first fluid channel extends through each of the tubular members between the space apart first and second walls; a plurality of second fluid channels defined between adjacent tubular members; wherein the plurality of tubular members are co-operatively configured such that the first fluid channels are fluidly interconnected defining an inlet manifold for inletting a heat exchange fluid into the plurality of first fluid channels and defining an outlet manifold for discharging the heat exchange fluid from the plurality of first fluid channels; a heat transfer surface disposed within each of the plurality of first fluid channels, wherein the heat transfer surface comprises: a pair of first and second spaced apart plates each defining an inner surface; a corrugated member disposed between the spaced apart first and second plates, the corrugated member including a plurality of transverse rows of corrugations disposed adjacent to one another and extending in an axial direction; wherein each row includes: a plurality of spaced apart upper and lower bridge portions; and a plurality of fin surface portions extending between and interconnecting the spaced apart upper and lower bridge portions; wherein the plurality of spaced apart upper and lower bridge portions and the plurality of fin surface portions are co-operatively configured such that an alternating series of upper and lower bridge portions interconnected by fin surface portions is formed defining a plurality of heat transfer enhancement-receiving spaces; the plurality of rows of corrugations includes at least a first row and at least a second row together defining at least one pair of adjacent rows of corrugations; for each one of the at least one pair of adjacent rows of corrugations, the first row is offset relative to the second row such that the corrugations in the first row partially overlap the corrugations in the adjacent second row; a plurality of heat transfer enhancement features disposed on the inner surfaces of the first and second spaced apart plates such that one of the plurality of heat transfer enhancement features is disposed in each heat transfer enhancement-receiving spaced defined by the alternating series of upper and lower bridge portions interconnected by fin surface portions of each row of corrugations.

In accordance with another example embodiment of the present disclosure there is provided a heat exchanger, comprising: a plurality of tubular members disposed in spaced apart, parallel, or substantially parallel, relationship to one another; a plurality of first fluid channels defined by the plurality of tubular members, each tubular member having spaced apart first and second walls such that first fluid channel extends through each of the tubular members between the space apart first and second walls; a plurality of second fluid channels defined between adjacent tubular members; wherein the plurality of tubular members are co-operatively configured such that the first fluid channels are fluidly interconnected defining an inlet manifold for inletting a heat exchange fluid into the plurality of first fluid channels and defining an outlet manifold for discharging the heat exchange fluid from the plurality of first fluid channels; a plurality of heat transfer enhancement features disposed on an inner surface of said first wall and on an inner surface of said second wall of each of said tubular members; a corrugated member disposed between the spaced apart first and second walls of each of the tubular members, the corrugated member including a plurality of transverse rows of corrugations disposed adjacent to one another and extending in an axial direction; wherein each row includes: a plurality of spaced apart upper and lower bridge portions; and a plurality of fin surface portions extending between and interconnecting the spaced apart upper and lower bridge portions; wherein the plurality of spaced apart upper and lower bridge portions and the plurality of fin surface portions are co-operatively configured such that an alternating series of upper and lower bridge portions interconnected by fin surface portions is formed defining a plurality of heat transfer enhancement-receiving spaces; wherein the plurality of rows of corrugations includes at least a first row and at least a second row together defining at least one pair of adjacent rows of corrugations; for each one of the at least one pair of adjacent rows of corrugations, the first row is offset relative to the second row such that the corrugations in the first row partially overlap the corrugations in the adjacent second row; and wherein the corrugated member is disposed between the spaced apart first and second walls of each of the tubular members such that one of the plurality of heat transfer enhancement features is disposed in each of the heat transfer enhancement-receiving spaces.

BRIEF DESCRIPTION OF THE DRAWINGS

Reference will now be made, by way of example, to the accompanying drawings which show example embodiments of the present application, and in which:

FIG. 14 illustrates results of heat transfer performance and friction factor test data for various heat transfer surfaces;

FIG. 15 illustrates results of heat exchanger performance testing for heat exchangers incorporating various heat transfer surfaces;

Similar reference numerals may have been used in different figures to denote similar components.

DESCRIPTION OF EXAMPLE EMBODIMENTS

Figure 1:
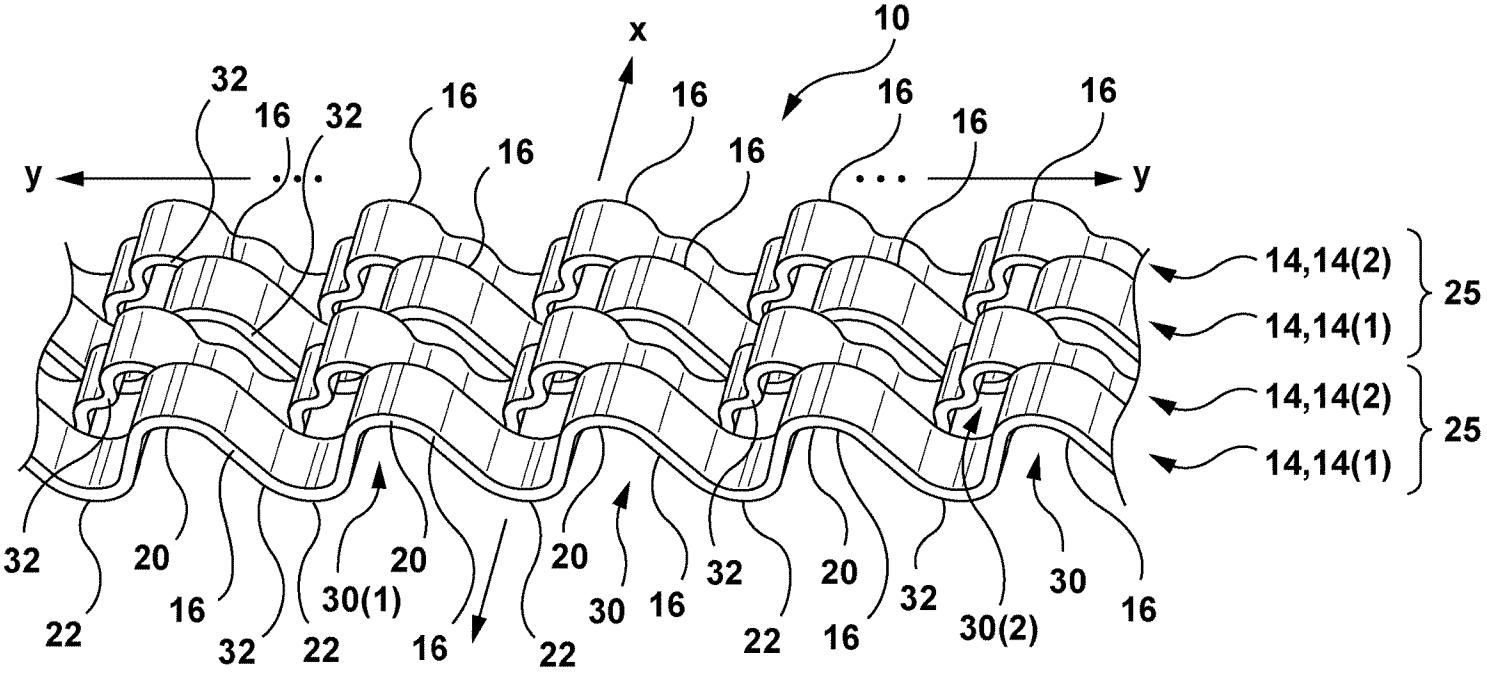
FIG. 1 is a perspective view of a portion of a heat transfer surface according to an example embodiment of the present disclosure.

Referring to FIG. 1 there is shown a heat transfer surface 10 for use with a heat exchanger according to an example embodiment of the present disclosure. In some embodiments, for example, the heat transfer surface 10 may be disposed within an enclosed fluid flow channel of a heat exchanger (not shown). In some embodiments, for example, the heat transfer surface 10 may also be attached to the outside surfaces of the enclosed fluid flow channels or tubular members that make up the heat exchanger or may be located between stacked, spaced apart fluid flow channels or tubular members that make up the heat exchanger. When heat transfer surfaces 10 are disposed inside enclosed fluid flow channels or heat exchanger tubes they are often referred to as turbulizers. When heat transfer surfaces 10 are disposed outside enclosed fluid flow channels or between stacked heat exchanger tubes they are often referred to as fins. For the purpose of this disclosure, the term "heat transfer surface" is used and is not intended to necessarily be limited to either a turbulizer or a fin, per se.

Figure 2:
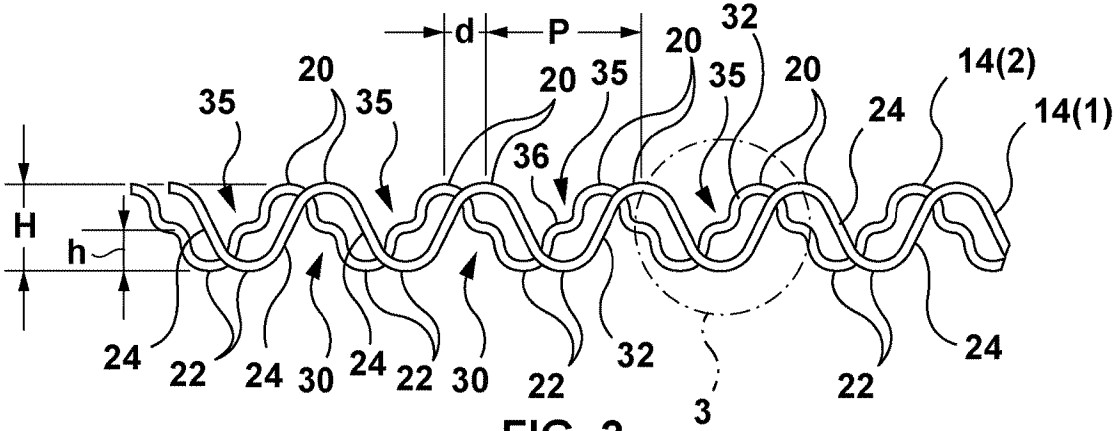
FIG. 2 is a front elevation view of the heat transfer surface of FIG. 1.
Figure 3A:
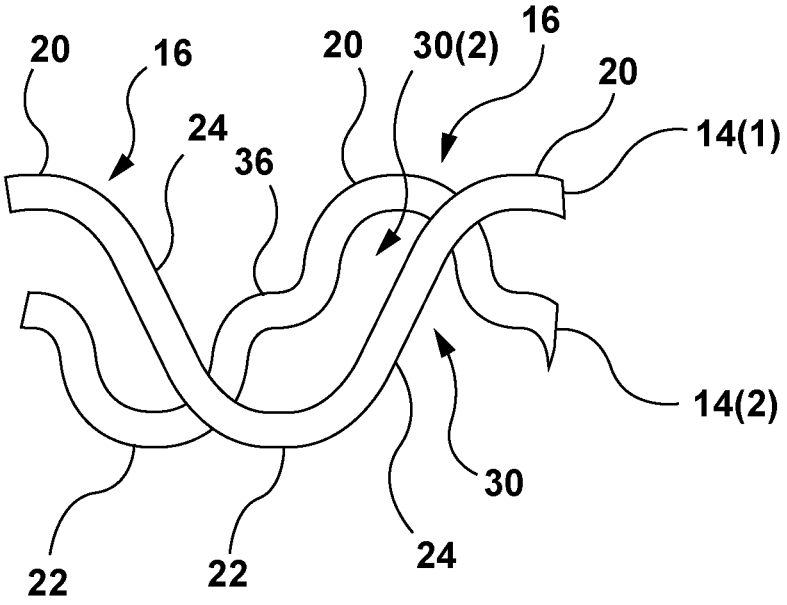
FIG. 3A is a detail front view of the encircled area 3 of FIG. 2 showing the offset corrugations.
Figure 3B:
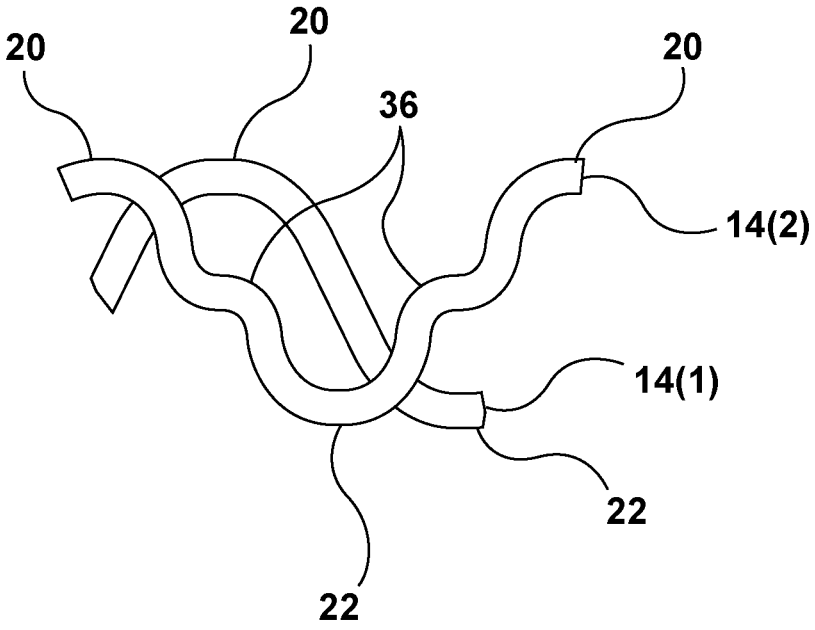
FIG. 3B is a detail rear view of the encircled area 3 of FIG. 2 showing the offset corrugations.

Referring in particular to FIGS. 1-3 there is shown a heat transfer surface according to a first example embodiment of the present disclosure. The heat transfer surface 10 includes a plurality of rows 14 of corrugations 16. The rows 14 are disposed adjacent to one another, in series, extending in a longitudinal or axial direction X-X of the heat transfer surface 10, the rows of corrugations extending transversely along axis Y-Y relative to the longitudinal or axial direction X-X.

Each row 14 includes a plurality of spaced apart upper and lower bridge portions 20, 22 interconnected by fin surface portions 24. The spaced apart upper and lower bridge portions 20, 22 and the fin surface portions 24 are co-operatively configured such than an alternating series of upper and lower bridge portions 20, 22 interconnected by fin surface portions 24 is formed. In some embodiments, for example, each corrugation 16 includes an upper bridge portion 20 and two fin surface portions 24 extending therefrom with each corrugation 16 being connected to the adjacent corrugation or corrugations 16 by a lower bridge portion 22. Alternatively, in some embodiments, for example, each corrugation 16 may include a lower bridge portion 22 and two fin surface portions 24 extending therefrom, with each corrugation 16 being connected to the adjacent corrugation or corrugations 16 by an upper bridge portion 20.

In some embodiments, for example, the plurality of rows of corrugations 14 include at least a first row 14(1) and at least a second row 14(2) which together define an set 25 of adjacent rows 14(1), 14(2) of corrugations 16. For each row 14 in the set 25 of adjacent rows 14, the second row 14(2) is offset relative to the first row 14(1) such that the corrugations in the first row 14(1) partially overlap the corrugations in the second row 14(2). As shown for instance in FIG. 2, the upper bridge portions 20 of the corrugations 16 in the first row 14(1) are offset or staggered relative to the upper bridge portions 20 of the corrugations 16 in the second row 14(2) by a predetermined distance d which, in some example embodiments, is about 50% of the overall width of an individual corrugation 16.

In some embodiments, for example, the heat transfer surface 10 is defined by a plurality of sets 25 of adjacent rows 14(1), 14(2) that are disposed in series thereby defining an alternating series of first rows 14(1) and second rows 14(2) extending in the axial direction X-X wherein the plurality of first rows 14(1) are offset relative to the plurality of second rows 14(2) in an alternating pattern. In some embodiments, for example, the plurality of sets 25 and the plurality of rows 14 of corrugations are connected in series with the plurality of sets 25 and the plurality of rows 14 being of unitary, one-piece construction. In some example embodiments, the heat transfer surface 10 is formed from a thin sheet of metal, such as aluminum, that is engaged between a set of dies that cuts or lances the sheet and displaces portions of the sheet of metal to form the alternating series of rows of corrugations of the corrugated heat transfer surface 10.

When heat transfer surface 10 is disposed within an enclosed fluid flow channel or heat exchanger tube, the upper and lower bridge portions 20, 22 generally are in contact, or substantially in contact, with the corresponding inside surfaces of the spaced apart first and second or upper and lower walls of the channel or tube.

Figure 4:
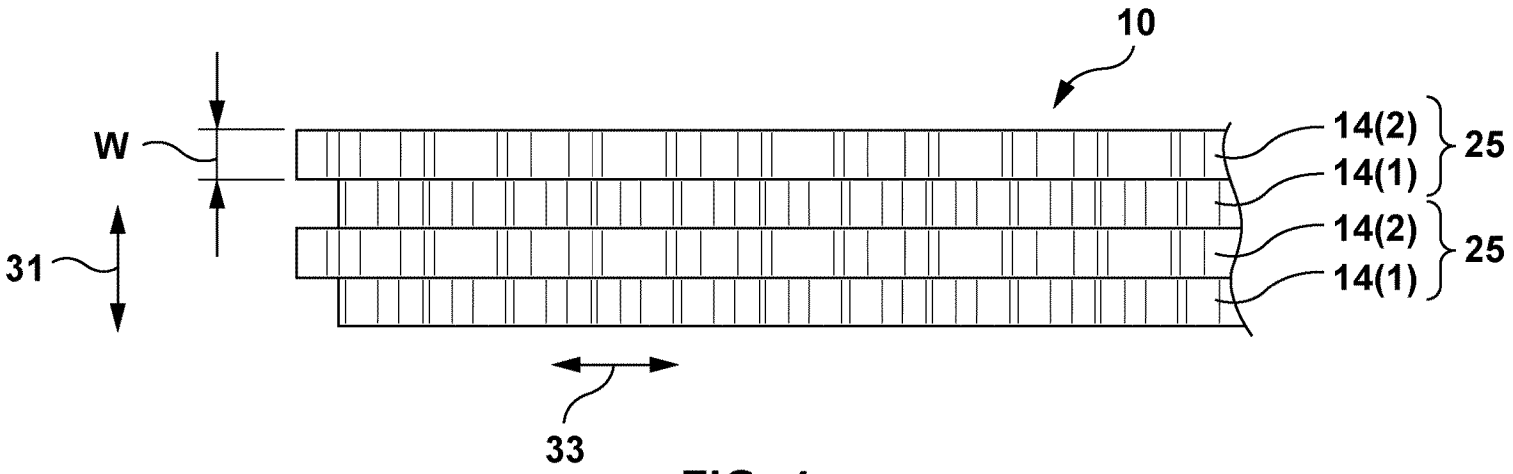
FIG. 4 is a top view of the heat transfer surface of FIG. 1.
Figure 5:
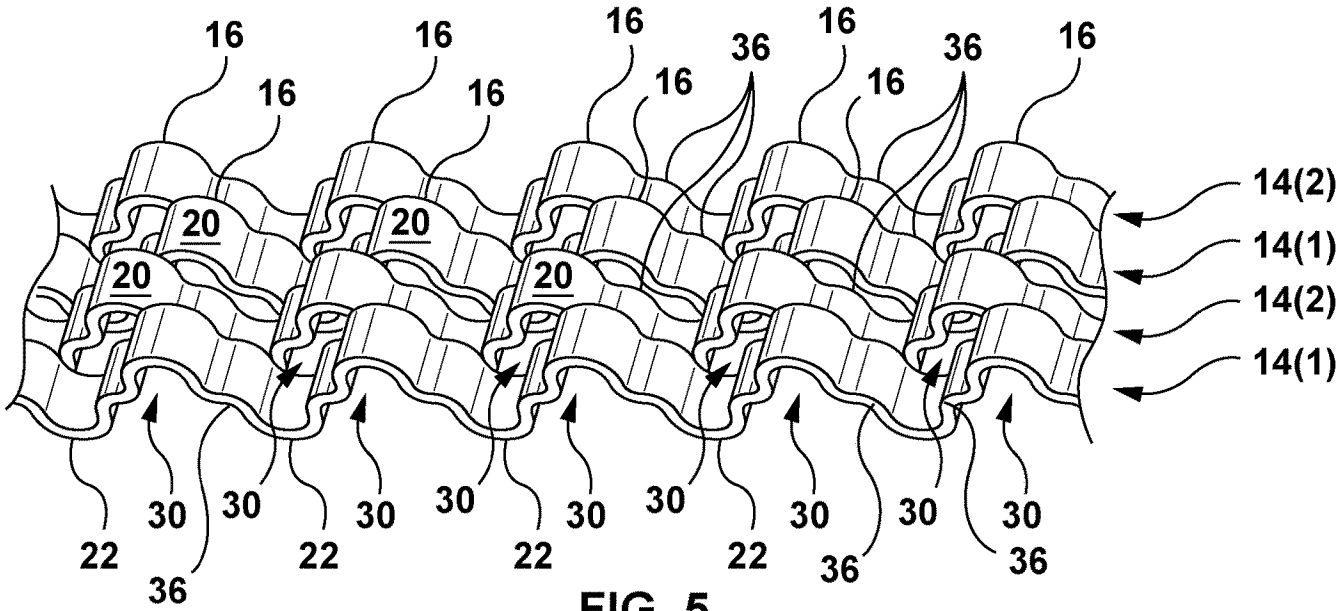
FIG. 5 is a perspective view of a portion of a heat transfer surface according to another example embodiment of the present disclosure.
Figure 6:
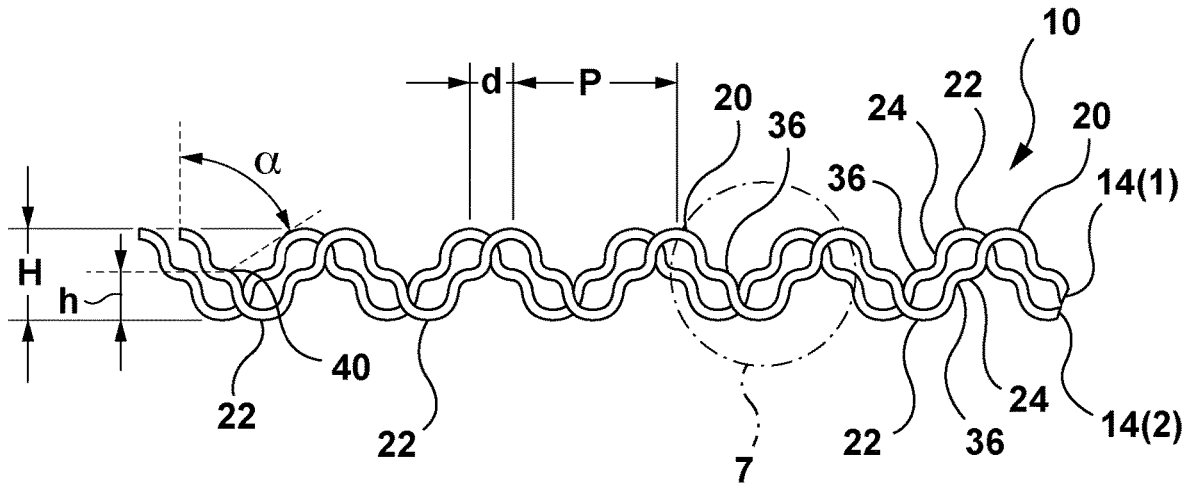
FIG. 6 is a front elevation view of the heat transfer surface of FIG. 5.
Figure 7:
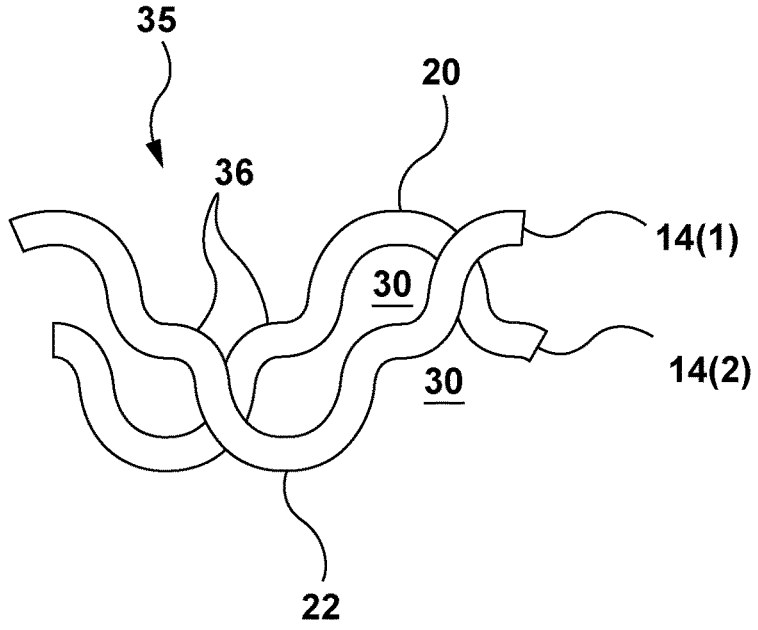
FIG. 7 is a detail view of the encircled area 7 of FIG. 6 showing the offset corrugations.

Referring to FIGS. 2-4, the corrugations 16 define apertures or fluid passageways 30 opening in the longitudinal or axial direction X-X. When the heat transfer surface 10 is arranged such that the apertures or fluid passageways 30 extend along the longitudinal or axial direction X-X of the heat transfer surface 10 in the direction of incoming fluid flow, the heat transfer surface 10 is disposed in what is commonly referred to as the low pressure drop direction (LPD) with each row of corrugations 14 defining an end edge 32 that serves as a leading edge. The low pressure drop (LPD) direction is illustrated schematically in FIG. 4 by flow directional arrow 31. When a fluid, for example oil, flows through the heat transfer surface 10, it will periodically encounter the end edge or leading edge 32 associated with the corrugations 16 in each row 14, creating turbulence within the fluid stream.

In some embodiments, for example, the heat transfer surface 10 may be arranged such that the apertures or fluid passageways 30 are oriented perpendicular, or substantially perpendicular, relative to the direction of incoming flow, the heat transfer surface 10, therefore, being disposed in what is commonly referred to as the high pressure drop direction (HPD). In this arrangement, the incoming fluid may impinge the fin surface portions 24 before being diverted through the apertures of fluid passageways 30 which also creates turbulence within the fluid stream and a more tortuous fluid flow. The high pressure drop (HPD) direction is illustrated schematically in FIG. 4 by flow directional arrow 33.

In order to enhance the heat transfer performance of the heat transfer surface 10, while in use with a heat exchanger, in some embodiments, the heat transfer surface 10 includes a heat transfer enhancement feature 35 disposed within the fin surface portion 24 between the upper and lower bridge portions 20, 22 of the corrugations 16 of at least some of the rows 14 of corrugations. In some embodiments, for example, the heat transfer enhancement feature 35 increases the surface area associated with the heat transfer surface 10 and/or increases the amount of turbulence introduced into the incoming fluid stream.

In some embodiments for example, the heat transfer enhancement feature 35 includes an additional or further corrugation or ridge 36 that is disposed intermediate the upper and lower bridge portions 20, 22 of the corrugations 16. The additional or further corrugation or ridge 36 is disposed within the fin surface portions 24, the fin surface portions 24 therefore defining a wavy or undulated surface or transition zone 40 between adjacent upper and lower bridge portions 20, 22. Each corrugation 16, therefore, is defined by an upper or lower bridge portion 20, 22 and fin surface portions 24 incorporating ridges 36 extending therefrom as shown for instance in FIGS. 2, 3A and 3B.

In some embodiments, for example, only some rows 14 of corrugations 16 of the heat transfer surface 10 include ridges 36. For instance, in the example embodiment shown in FIGS. 1-4, only the second rows 14(2) or even numbered rows in the series of alternating first rows 14(1) and second rows 14(2) include ridges 36 while the first rows 14(1) have corrugations 16 with fin surface portions 24 that are free of the additional ridge 36.

In other embodiments, for example, each row 14 of corrugations 16 within the heat transfer surface 10 includes ridges 36 formed in each of the fin surface portions 24 that extend between and interconnect the upper and lower bridge portions 20, 22 as shown, for example, in FIGS. 5-8. In the subject example embodiment, the apex 40 of ridge 36 is disposed at an angle, a, relative to a vertical axis through the midpoint or apex of the upper bridge portions 20 corrugations 16 and is disposed at a level or height, h, that is about the midway or halfway point of the overall height, H, of the corrugations 16. However, it will be understood that the specific location of the ridges 36 relative the upper and lower bridge portions 20, 22 of corrugations 16 may depend on the particular application for the heat transfer surface 10 and/or the desired fluid flow properties for fluid flowing through the heat transfer surface 10.

Figure 13:
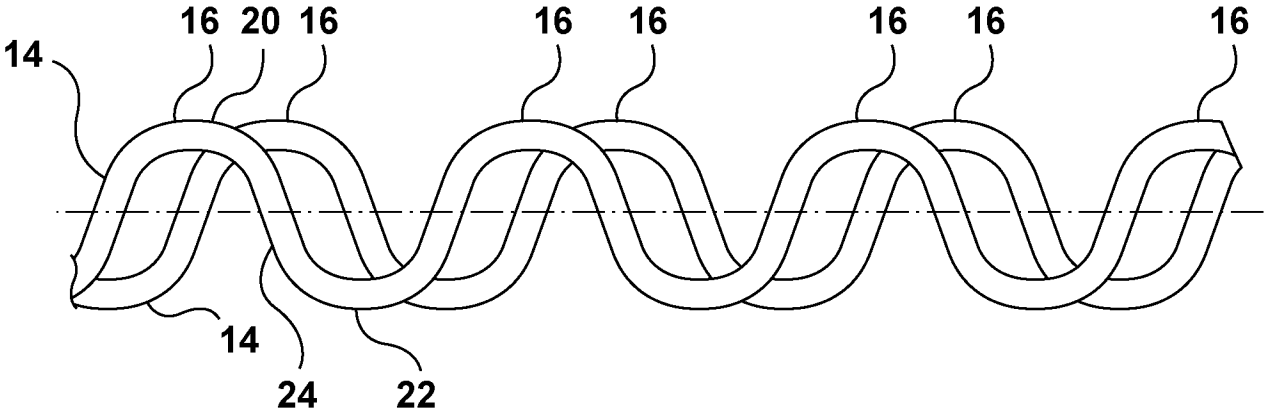
FIG. 13 (Prior Art)
FIG. 13 is front elevation view of a heat transfer surface according to the prior art.

The addition of ridge 36 to the fin surface portions 24 that extend between and interconnect the upper and lower bridge portions 20, 22 results in a heat transfer surface 10 having a more undulated profile as compared to more traditional heat transfer surfaces such as the type of heat transfer surface shown in FIG. 13 which is commonly referred to as an offset strip fin.

When only some of the rows 14(2) of corrugations 16 include ridges 36, such as in the example embodiment of FIGS. 1-4, the apertures 30(2) defined by the corrugations 16 with ridges 36 have a more convoluted shape as compared to the apertures 30(1) defined by the corrugations 16 that are free from ridges 36. By having the alternating rows 14(1), 14(2) of corrugations 16 offset relative to one another, apertures 30(1) in the first rows 14(1) partially overlap the apertures 30(2) formed by the corrugations 16 in the second rows 14(2) which alternating pattern of apertures 30(1), 30(2) defines a more tortuous or turbulent flow path through the heat transfer surface 10.

When all of the rows 14(1), 14(2) of corrugations 16 include ridges 36, such as in the example embodiment of FIGS. 5-8, the apertures 30 defined by the corrugations 16 all have the same shape or profile. When the corrugations 16 in the first rows 14(1) overlap the corrugations 16 in the second rows 14(2), the overlapping apertures 30 together define an even more tortuous and/or turbulent flow path through the heat transfer surface 10. The addition of ridges 36 within corrugations 16 has been found to increase turbulence within the incoming fluid stream which, in turn, has been found to increase the overall heat transfer performance associated with the heat transfer surface 10 when in use within a heat exchanger.

Referring now to FIGS. 14-15 there is shown performance data for heat exchanger channels incorporating different heat transfer surfaces. The illustrated performance data provides a comparison between a traditional offset strip fin, as shown for example in FIG. 13, wherein the heat transfer surface is comprised of a plurality of rows of corrugations wherein each row is offset with respect to the previous row in an alternating pattern identified as the "epsilon" heat transfer surface in FIGS. 14 and 15 and the more wavy, or undulated, heat transfer surface 10 shown in FIGS. 5-8 wherein a heat transfer enhancement features 35 in the form of a protrusion or corrugation disposed within the fin surface portion 24 between the upper and lower bridge portions or each row 14 of corrugations 16 identified as the "wavy epsilon" heat transfer surface 10 in FIGS. 14-15. As shown in FIG. 14, the average heat transfer performance for the "wavy epsilon" heat transfer surface 10 as shown in FIGS. 5-8 is greater than the heat transfer performance exhibited by the traditional or "epsilon" turbulizer, as shown in FIG. 13, for fluid flow with Reynolds Number less than 100 (e.g. $1<Re<100$) as well as for fluid flow with a Reynolds Number greater than 100 (e.g. $Re>100$). As well, the "wavy epsilon" heat transfer surface 10 (as shown in FIGS. 5-8) was found to exhibit reduced friction losses as compared to the "epsilon" or traditional turbulizer. The overall performance data for a heat exchanger incorporating various heat transfer surfaces, namely a traditional "epsilon" turbulizer as shown in FIG. 13 and a "way epsilon" heat transfer surface 10 as shown in FIGS. 5-8 is shown in FIG. 15 which illustrates that the wavy epsilon heat exchanger of FIGS. 5-8 demonstrates improved pressure drop characteristics as well as improved overall heat transfer as compared to a heat exchanger incorporating a traditional turbulizer.

Figure 9:
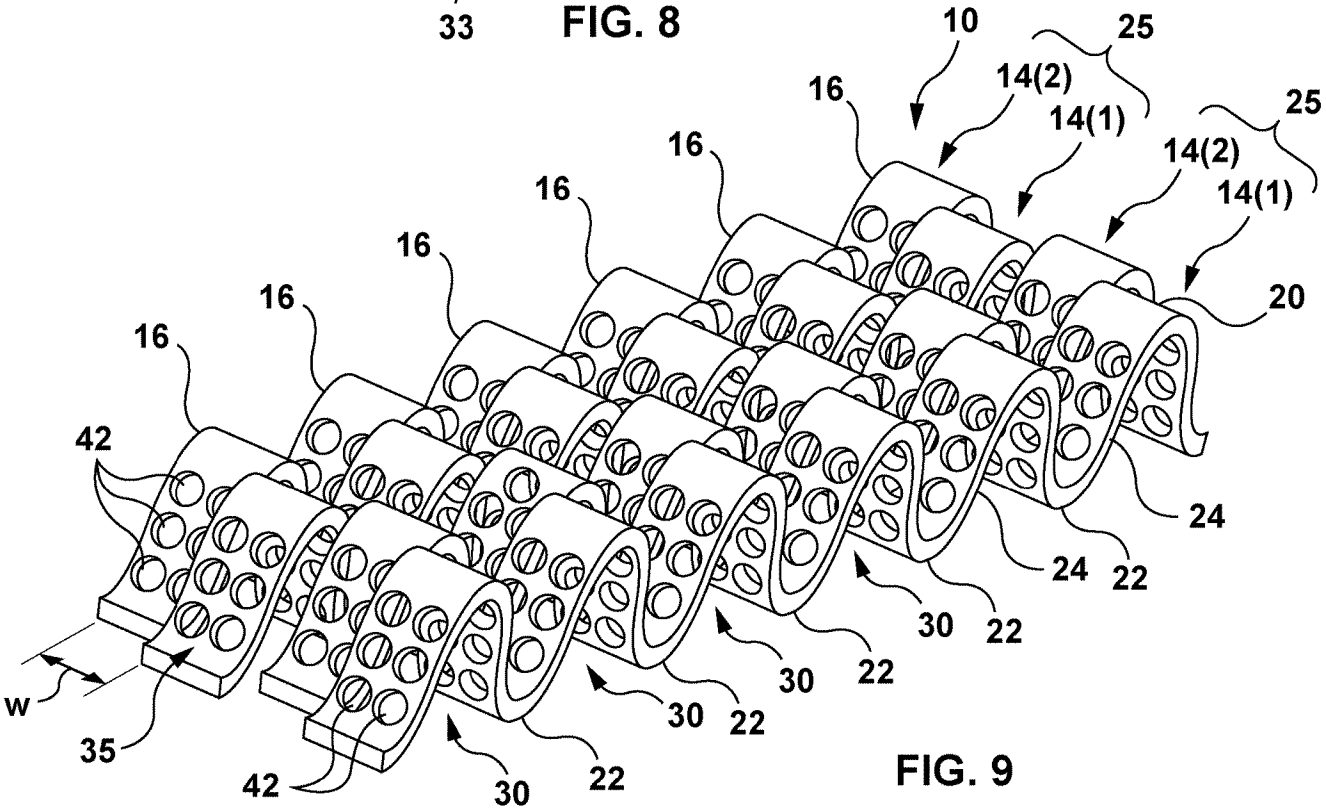
FIG. 9 is a perspective view of a portion of a heat transfer surface according to another example embodiment of the present disclosure.

Referring now to FIG. 9, there is shown another example embodiment of the present disclosure. More specifically, in some embodiments, for example, rather than providing a heat transfer enhancement feature 35 in the form of a protrusion 30 disposed within the fin surface portion 24 intermediate the upper bridge portion and lower bridge portion 20, 22 of the corrugations 16, the heat transfer surface 10 includes a heat transfer enhancement feature 35 in the form of a plurality of openings 42 defined within the fin surface portions 24 that extend between and interconnect the upper and lower ridges 20, 22. In the subject example embodiment, therefore, the fin surface portions 24 define a porous surface portion. In some embodiments, for example, the openings 42 are generally circular and have a predetermined diameter and are spaced apart from each other by a predetermined distance so as to define a fin surface portion 24 having a porosity within a predetermined range. In some embodiments, for example, the diameter of the apertures 42 is in the range of about 0.25 mm to 2 mm. In other embodiments, for example, the openings or apertures 42 may have a shape other than generally circular, such as, for instance oval or rectangular. In some embodiments, for example, the plurality of openings or apertures 42 may have different shapes. In some embodiments, for example, the plurality of openings 42 are arranged in a staggered pattern over the fin surface portions 24. By incorporating a plurality of openings 42 in the fin surface portions 24 of corrugations 16, a more tortuous fluid path through the heat transfer surface 10 is defined which, in turn, may help to increase turbulence within the incoming fluid stream which may also serve to increase overall heat transfer performance.

Figure 8:
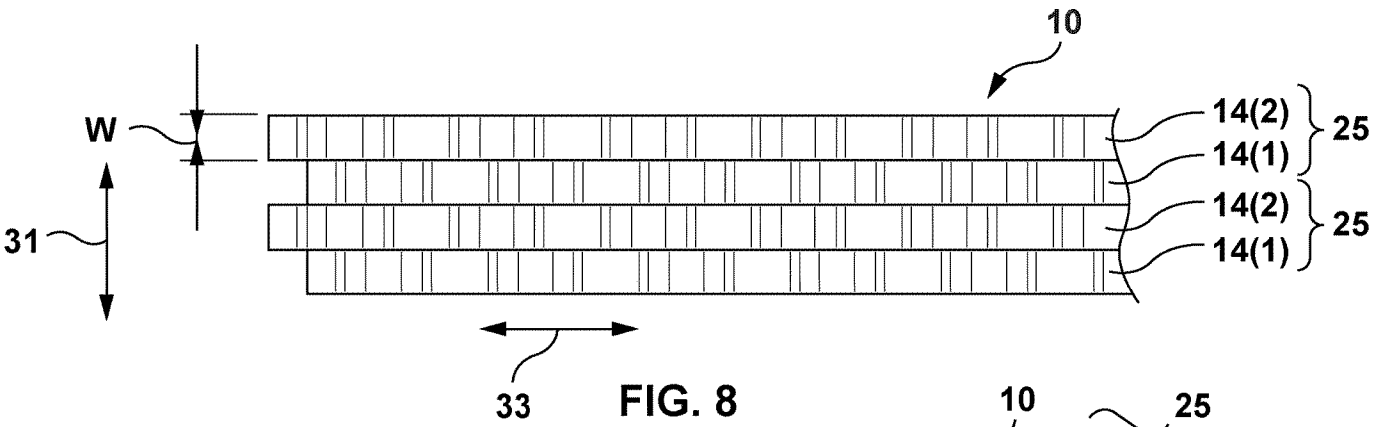
FIG. 8 is a top view of the heat transfer surface of FIG. 5.

In some embodiments, for example, in order to accommodate the plurality of openings or apertures 42 disposed in the fin surface portions 24 with width, W, of each row 14 of corrugations 16, as shown for instance in FIGS. 4 and 8 may be larger than the width, W, of the rows 14 of corrugations 16 that include heat transfer enhancement features 35 in the form of a plurality of apertures 42. In some embodiments, for example, the width, W> may be in the range of about 1.016 mm to about 20 mm.

In some embodiments, for example, the fin surface portions 24 of the heat transfer surface 10 may include ridge portions 36 as well as the plurality of openings 42.

Figure 10:
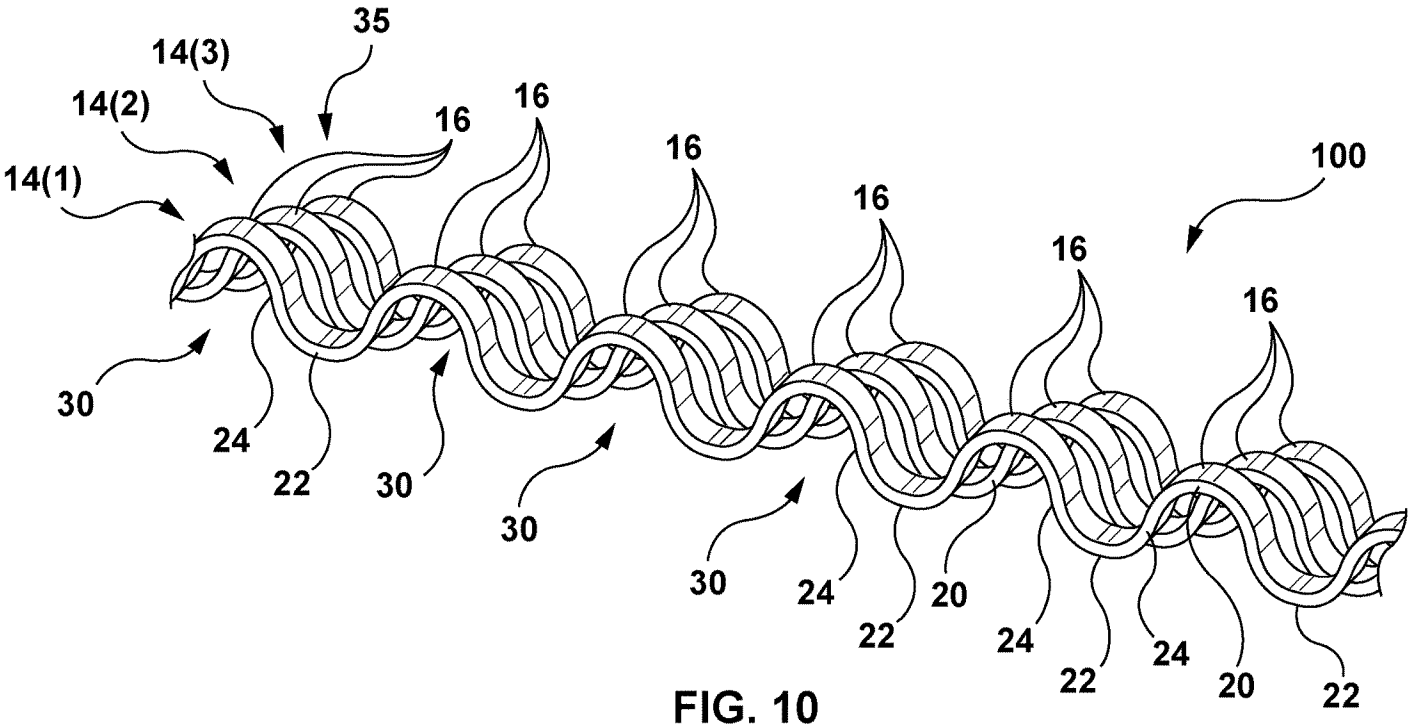
FIG. 10 is a perspective view of a portion of a heat transfer surface according to another example embodiment of the present disclosure.
Figure 11:
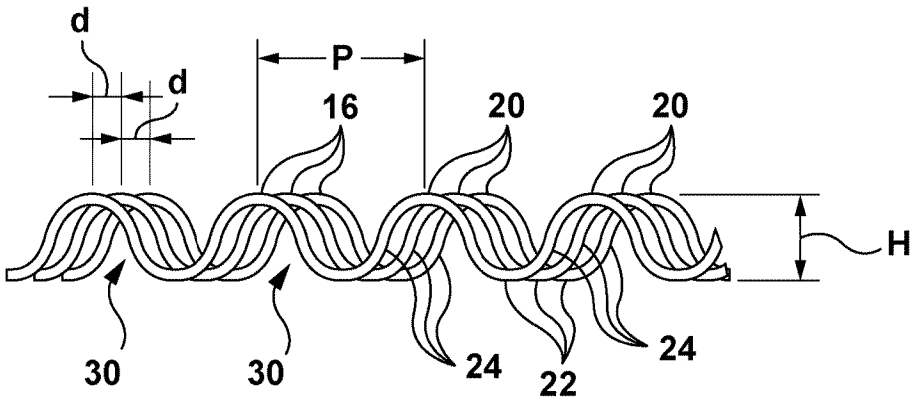
FIG. 11 is a front elevation view of the heat transfer surface of FIG. 10.
Figure 12:
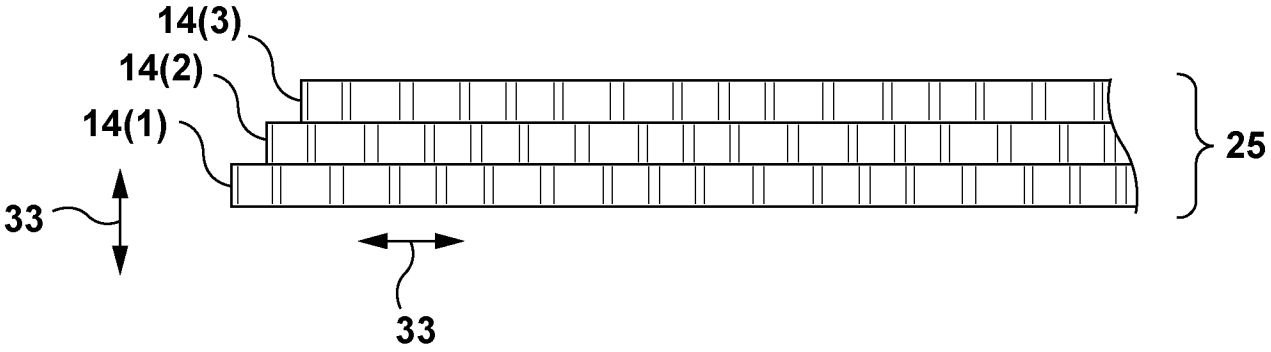
FIG. 12 is a top view of the heat transfer surface of FIG. 10.

Referring now to FIGS. 10-12, there is shown a heat transfer surface 100 according to another example embodiment of the present disclosure. In the subject example embodiment, the heat transfer surface 100 has generally the same structure as discussed above in connection with FIGS. 1-9, however, rather than being formed by a plurality of sets 25 of two rows of corrugations 14(1), 14(2), the heat transfer surface 100 is comprised of a plurality of sets of three rows of corrugations disposed in a repeating pattern. Accordingly, in some embodiments, for example, rather than having a heat transfer enhancement feature 35 disposed within the fin surface portions 24 of the corrugations 16, the heat transfer enhancement feature 35 includes a third row 14(3) of corrugations 16 added to the repeating group or sets 25 of rows 14 that make up the heat transfer surface 100, with the third row of corrugations 14(3) being positioned such that it is offset or staggered with respect to both the first and second rows of corrugations 14(1), 14(2).

Accordingly, in the subject example embodiment, the heat transfer surface 100 comprises at least a first row 14(1) of corrugations 16, at least a second row 14(2) of corrugations 16, and at least a third row 14(3) of corrugations 16 wherein the second row 14(2) of corrugations 16 is offset relative to the first row 14(1) of corrugations 16 and wherein the third row 14(3) is offset relative to both the first and second rows 14(1), 14(2) as shown, for example, in FIG. 10. Depending on the overall size of the heat transfer surface 100, which will likely depend on the overall size of the heat exchanger into which the heat transfer surface 100 will be incorporated, whether it be within enclosed fluid channels or external to the enclosed fluid channels, the first, second and third rows 14(1), 14(2), 14(3) of corrugations 16 together form the set 25 of adjacent rows 14, which set 25 may be repeated or disposed adjacent to one another in the longitudinal or axial direction X-X so as to form a repeating series of offset rows 14(1), 14(2), 14(3) of corrugations 16.

In order to accommodate the third row 14(3) of corrugations 16 in the repeating set 25 of rows or corrugations 16 that makes up the heat transfer surface 100, the overall pitch, P, associated with the corrugations 16 in each row 14 may be larger than the pitch associated with the corrugations 16 in each row in the example embodiments of FIGS. 1-9 where the set 25 included only adjacent first and second rows 14(1), 14(2) of corrugations 16. It will be understood that reference to the pitch associated with the corrugations is in reference to the distance between the apex of one corrugation 16 to the apex of the adjacent corrugation 16 in the same row 14 of corrugations. In some embodiments, for example, the pitch, P, associated with the corrugations 16 in the rows 14(1), 14(2), 14(3) or corrugations that form the set 25 is about between about 2.5 mm to about 8 mm. In some embodiments, for example, the pitch, P, is about 3.83 mm.

As well, rather than having the corrugations 16 in adjacent rows 14 offset by about 50% relative to each other along the transverse axis Y-Y (or high pressure drop direction) as described in connection with the example embodiments of FIGS. 1-9, in embodiments where the set 25 includes three rows 14(1), 14(2), 14(3) of corrugations 16, as shown for instance in FIG. 11, the corrugations 16 in one row may instead be offset relative to the corrugations 16 in the adjacent row or rows 14 by between about 23% to about 33% relative to each other along the transverse axis Y-Y (or high pressure drop direction). In some embodiments, for example, the first row of corrugations 14(1) is offset with respect to the adjacent second row of corrugations 14(2) by a distance, d, of about 0.38 mm to about 0.728 mm along an axis that extends parallel to the row of corrugations. In some embodiments, for example, the distance, d, is about 0.440 mm to about 0.638 mm along an axis that extends parallel to the row of corrugations. The decrease in the amount of offset between adjacent rows 14(1), 14(2), 14(3) of corrugations is with effect that the portion of the apertures 30 or fluid passageways defined by each of the corrugations 16 that is exposed to the incoming fluid stream between the adjacent rows 14(1), 14(2), 14(3) of corrugations 16, when the heat transfer surface is disposed in the low pressure drop direction or orientation, is also decreased. This decrease in the size of the apertures of fluid passageways 30 that is uninterrupted when exposed to an incoming fluid stream serves to create a more tortuous and/or turbulent flow path through the heat transfer surface 100, which increase in turbulence may result in improved overall performance of the heat exchanger incorporating the heat transfer surface 100.

Figure 16:
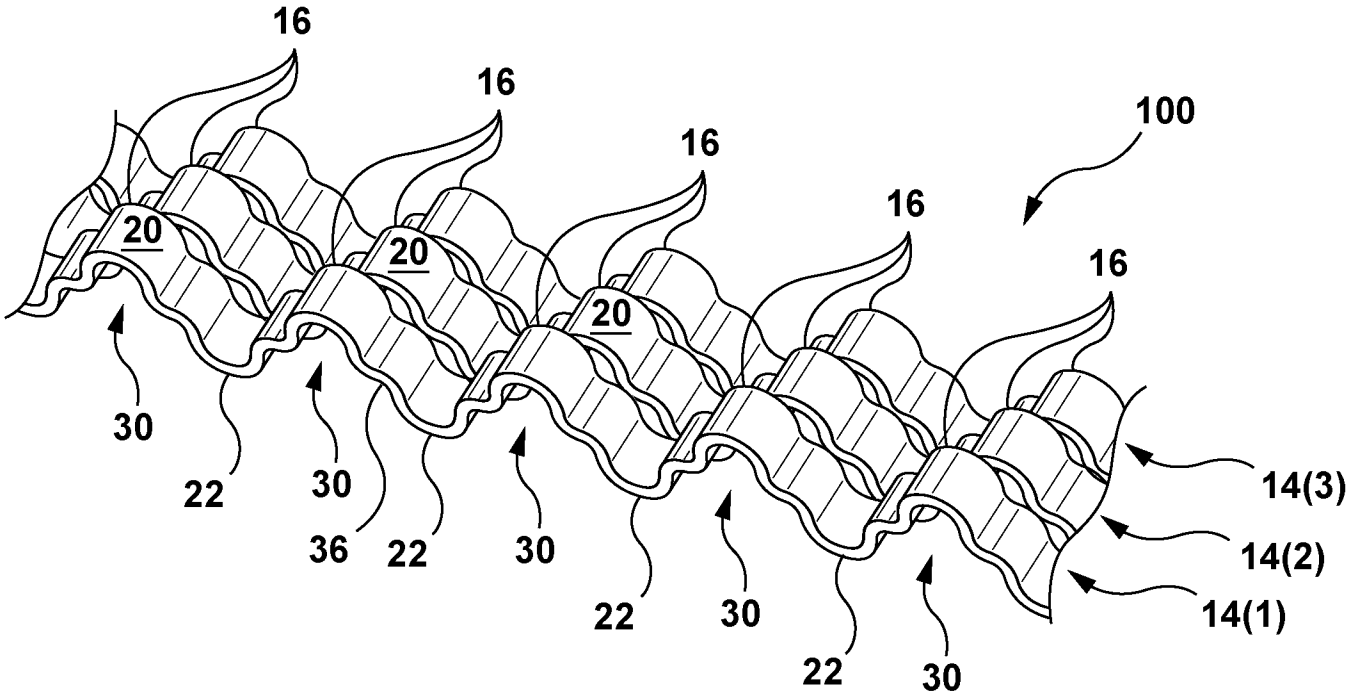
FIG. 16 is a perspective view of a portion of a heat transfer surface according to an example embodiment of the present disclosure.
Figure 17:
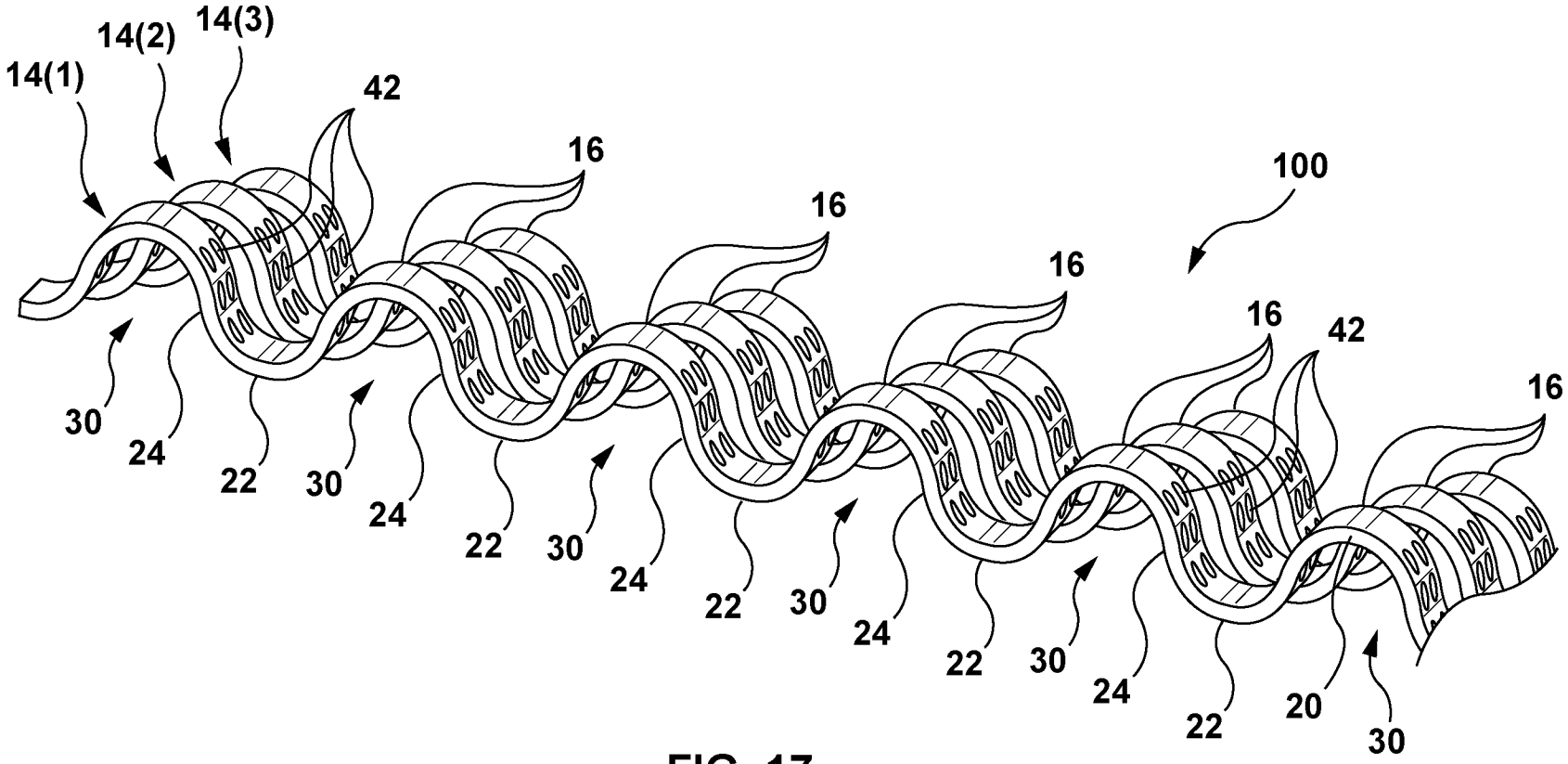
FIG. 17 is a perspective view of a portion of a heat transfer surface according to an example embodiment of the present disclosure.

In some embodiments, for example, the heat transfer surface 100 may also include a heat transfer enhancement feature 35 disposed within the fin surface portions 24 of the corrugations 16 of at least some of the rows 14 of corrugations. In some embodiments, for example, the heat transfer surface 100 may include heat transfer enhancement features 35 in the form of ridges or protrusions 36 that project out of the surface of the fin surface portions 24 as described above in connection with the example embodiments of FIGS. 1-8. In some embodiments, for example, the ridges 36 may be included in every other row, as shown for instance in FIG. 16 while in other embodiments the ridges 36 may be included in each row as shown for instance in FIG. 17. In some embodiments, for example, the heat transfer surface 100 may include a heat enhancement feature 35 in the form of the plurality of openings 42 disposed within the fin surface portions 24 to form porous fin surface portions extending between the upper and lower ridges 20, 22 of the rows 14 of corrugations 16 as described above in connection with the example embodiment of FIG. 9 and as shown for instance in FIG. 18.

Referring now to FIGS. 18-21, another example embodiment of the present disclosure will be described.

Figure 18:
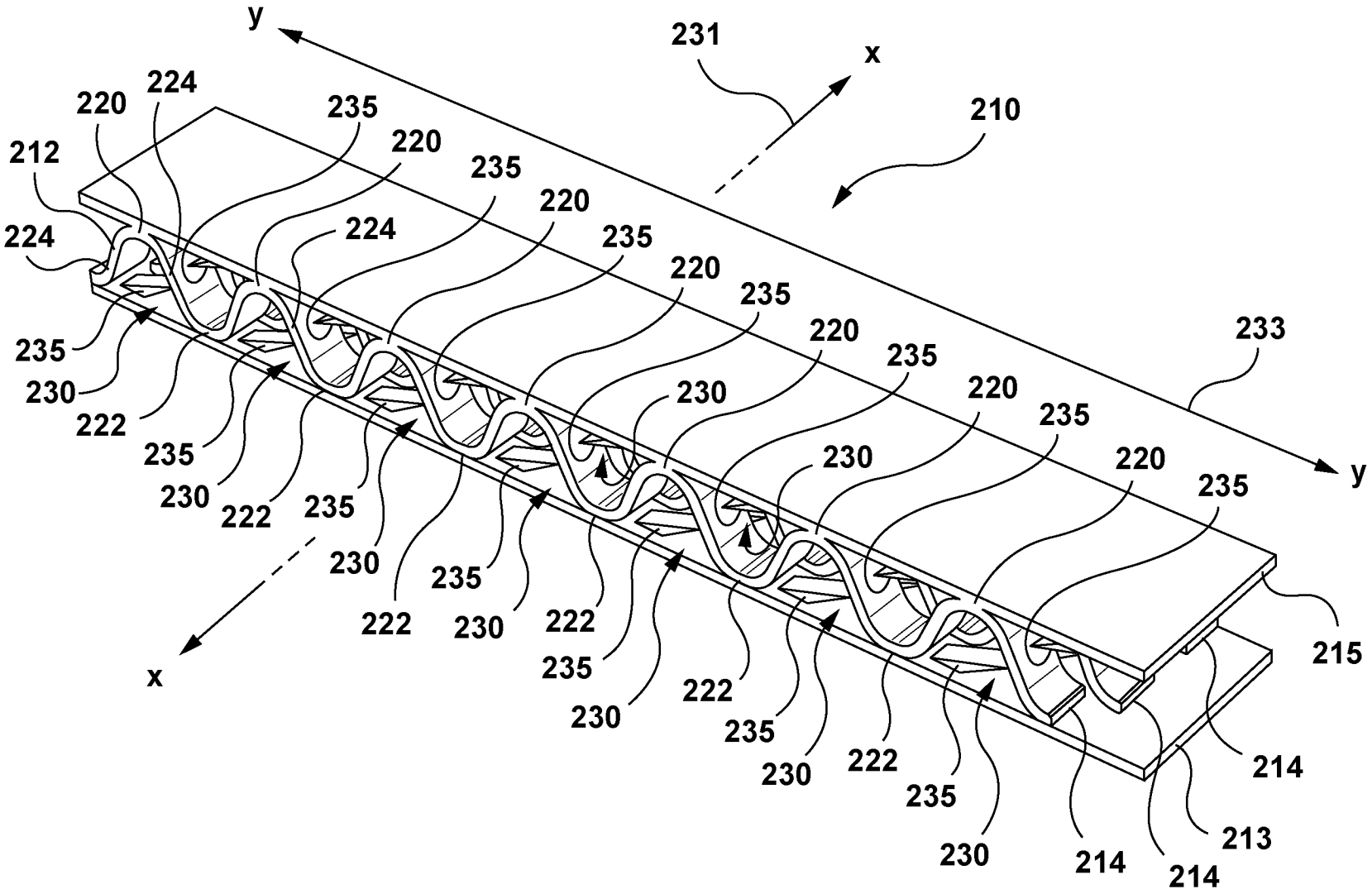
FIG. 18 is a perspective view of a portion of a heat transfer surface or heat exchanger channel according to another example embodiment of the present disclosure.
Figure 19:
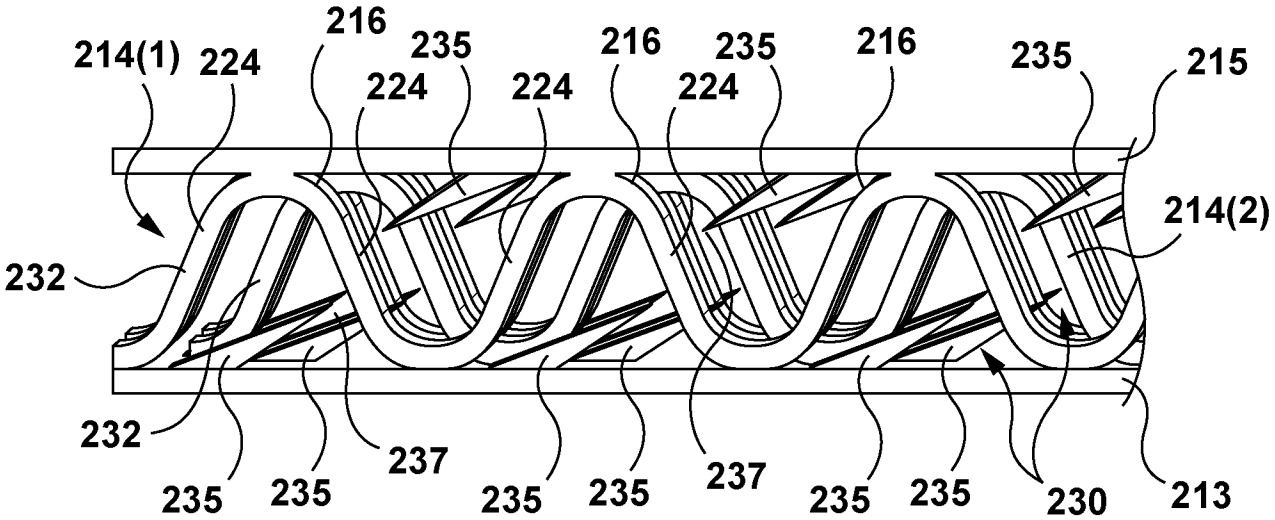
FIG. 19 is a front elevation view of the heat transfer surface or heat exchanger channel of FIG. 18.

Referring to FIGS. 18 and 19 there is shown a portion of a heat transfer surface or portion of a heat exchanger channel 210 according to an example embodiment of the present disclosure. The heat transfer surface or heat exchanger channel 210 includes a corrugated member 212 disposed between first and second spaced apart plates 213, 215, the first and second plates 213, 215 including a plurality of spaced apart heat transfer enhancement features 235 disposed in relation to the positioning or placement of the corrugated member 212 between or relative to plates 213, 215 as will be described in further detail below.

Figure 20:
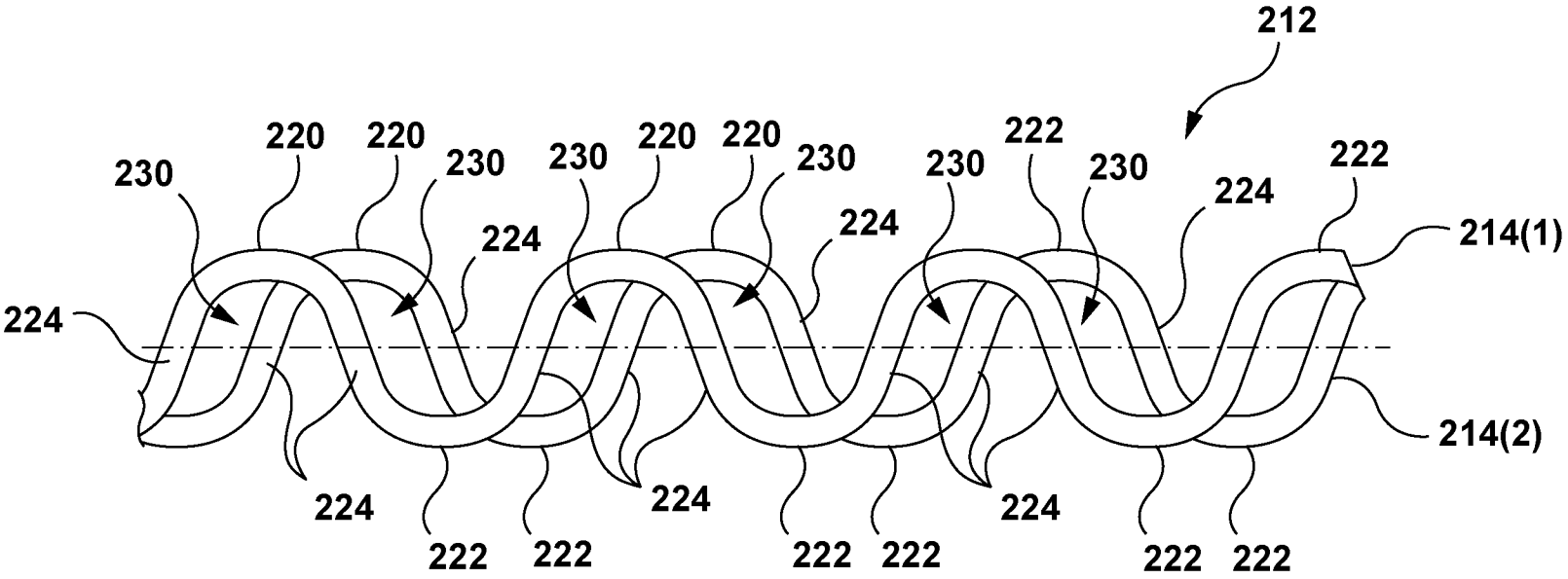
FIG. 20 is a front elevation view of a portion of the heat transfer surface or heat exchanger channel of FIG. 18.

Referring now to FIG. 20, the corrugated member 212 of the heat transfer surface or portion of heat exchanger channel 210 is described in further detail. The corrugated member 212 includes a plurality of rows 214 of corrugations 216. The rows 214 are disposed adjacent to one another, in series, and extend in a longitudinal or axial direction X-X of the corrugated member 212, the rows 214 of corrugations 216 extending transversely along axis Y-Y relative to the longitudinal or axial direction X-X.

As described above in relation to the previously described example embodiments, each row 214 includes a plurality of spaced apart upper and lower bridge portions 220, 222 interconnected by fin surface portions 224. The spaced apart upper and lower bridge portions 220, 222 and the fin surface portions 224 are co-operatively configured such than an alternating series of upper and lower bridge portions 220, 222 interconnected by fin surface portions 224 is formed. In some embodiments, for example, each corrugation 216 includes an upper bridge portion 20 and two, fin surface portions 224 extending therefrom with each corrugation 216 being connected to the adjacent corrugation or corrugations 16 by a lower bridge portion 222. Alternatively, in some embodiments, for example, each corrugation 16 may include a lower bridge portion 222 and two fin surface portions 224 extending therefrom, with each corrugation 216 being connected to the adjacent corrugation or corrugations 216 by an upper bridge portion 220.

In some embodiments, for example, the plurality of rows of corrugations 214 include at least a first row 214(1) and at least a second row 214(2) which together define an set 225 of adjacent rows 214(1), 214(2) of corrugations 216. For each row 214 in the set 225 of adjacent rows 214, the second row 214(2) is offset relative to the first row 214(1) such that the corrugations in the first row 214(1) partially overlap the corrugations in the second row 214(2). As shown for instance in FIG. 21, the upper bridge portions 220 of the corrugations 216 in the first row 214(1) are offset relative to the upper bridge portions 220 of the corrugations 216 in the second row 214(2) by a predetermined distance, d, which, in some example embodiments, is about 50% of the overall width of an individual corrugation 216.

In some embodiments, for example, the heat transfer surface 210 is defined by a plurality of sets 225 of adjacent rows 214(1), 214(2) that are disposed in series thereby defining an alternating series of first rows 214(1) and second rows 214(2) extending in the axial direction X-X wherein the plurality of first rows 214(1) are offset relative to the plurality of second rows 214(2) in an alternating pattern.

The corrugated member 212 is disposed between upper and lower or first and second plates 213, 215. In some embodiments, for example, the corrugated member 212 and the first and second plates 213, 215 are formed using additive manufacturing techniques and are a unitary, one piece construction. In other embodiments, the corrugated member 212 is separate to the first and second plates 213, 215, the corrugated member 212 and the first and second plates 213, 215 being joined together for instance, via brazing, forming a unit. Regardless of the manufacturing technique(s) used, the corrugated member 212 and the first and second plates 213, 215 together may be disposed within the enclosed fluid flow channels of a separate heat exchanger (not shown), or may be attached to the outside surfaces of the enclosed fluid flow channels or tubular members that make up the heat exchanger.

In other embodiments, for example, the corrugated member 212 and the first and second plates 213, 215 together may be located between stacked, spaced apart fluid flow channels or tubular members that make up the heat exchanger. When the corrugated member 212 and the first and second plates 213, 215, together, are disposed inside or outside enclosed fluid flow channels or heat exchanger tubes they, together, serve as a heat transfer surface commonly referred to as either a turbulizer or fin.

In other embodiments, for example, the corrugated member 212 is separate to the first and second plates 213, 215, the first and second plates 213, 215 being the spaced apart walls of an enclosed fluid flow channel 250 of a heat exchanger 300. Accordingly, it will be understood that in some embodiments, the first and second plates 213, 215 are separate to the spaced apart walls that form the enclosed fluid flow channels of a heat exchanger while in other embodiments, the first and second plates 213, 215 referred to in the drawings may be separate and in addition to the spaced apart walls that form the enclosed fluid flow channels of a heat exchanger. Therefore, whether the first and second plates 213, 215 are separate to the spaced apart walls that form the enclosed fluid flow channels of a heat exchanger or whether they themselves are the spaced apart walls of the enclosed fluid flow channels of a heat exchanger, it will be understood that together with corrugated member 212 they define a flow passage 219 through which a fluid is intended to flow.

When corrugated member 212 is disposed between the first and second plates 213, 215, the upper and lower bridge portions 220, 222 generally are in contact, or substantially in contact, with the corresponding inside surfaces of the spaced apart first and second plates 213, 215. The corrugations 216 define apertures or fluid passageways or heat transfer enhancement-receiving spaces 230 opening in the longitudinal or axial direction X-X.

In order to enhance the heat transfer performance of the heat transfer surface or channel 210, the first and second plates 213, 215 include heat transfer enhancement features 235 disposed on the inner surfaces 221, 223 of the first and second plates 213, 215. The heat transfer enhancement features 235 are in the form of triangular tabs, projections or protuberances that are raised or protrude out of the surface of the first and second plates 213, 215. The heat transfer enhancement features or triangular projections/protuberances 235 each have a tip 237 that protrudes or extends out of the inner surface of the plates 213, 215, the heat transfer enhancement features or triangular projections/protuberances 235 being disposed such that one heat transfer enhancement feature or triangular projections/protuberance 235 is positioned within each aperture or fluid passageway or heat transfer enhancement-receiving space 230 formed by each of the corrugations 216 in the corrugated member 212 when disposed between plates 213, 215.

Accordingly, as shown most clearly in FIGS. 18 and 19, the heat transfer enhancement features or triangular projections/protuberances 235 formed on the inner surface of the first plate 213 are disposed underneath the upper bridge portion 220 in between the two fin surface portions 224 extending therefrom. The heat transfer enhancement features or triangular projections/protuberances 235 formed on the inner surface of the second plate 215 are disposed in the aperture or fluid passageway 230 formed by the lower bridge portion 222 and two adjacent fin surface portions 224 that extend therefrom and connect to the adjacent upper bridge portion(s) 220.

In some embodiments, for example, the heat transfer enhancement features or triangular projections/protuberances 235 that extend from the first plate 213 and the heat transfer enhancement features or triangular projections/protuberances 235 that extend from the second plate 215 are disposed such that the tips 237 of the heat transfer enhancement features or triangular projections/protuberances 235 that extend from the first plate 213, independently, are oriented towards the tips 237 of the heat transfer enhancement features or triangular projections/protuberances 235 that extend from the second plate 215 of the adjacent corrugation 216 or aperture 230 defined by the adjacent corrugation 216.

Since the corrugated member 212 includes a plurality of alternating first and second rows 214(1), 214(2) of corrugations 216 that are arranged such that the second rows 214(2) are offset relative to the adjacent first row or rows 214(1) along the transverse axis Y-Y, the heat transfer enhancement features or triangular projections/protuberances 235 in one row 214 are also offset relative to heat transfer enhancement features or triangular projections/protuberances 235 in the adjacent row or rows of heat transfer enhancement features or triangular projections/protuberances 235.

When the heat transfer surface or channel 210 is arranged such that the apertures or fluid passageways 230 of the corrugated member 12 extend along the longitudinal or axial direction X-X of the heat transfer surface 210 in the direction of incoming fluid flow, the heat transfer surface 210 is disposed in what is commonly referred to as the low pressure drop direction (LPD) with each row of corrugations 214 defining an end edge 232 that serves as a leading edge. The low pressure drop (LPD) direction is illustrated schematically in FIG. 18 by directional arrow or longitudinal axis 231. When a fluid, for example oil, flows through the heat transfer surface or channel 210, it will periodically encounter the end or leading edges 232 associated with the corrugations 16 of each row 214 and will also encounter the edges of the heat transfer enhancement features or triangular projections/protuberances 235 disposed within each corrugation 216 creating turbulence within the fluid stream.

In other embodiments, for example, the heat transfer surface or channel 210 may be arranged such that the apertures or fluid passageways 230 are oriented perpendicular, or substantially perpendicular, relative to the direction of incoming flow, the heat transfer surface 210, therefore, being disposed in what is commonly referred to as the high pressure drop direction (HPD). In this arrangement, the incoming fluid may impinge the fin surface portions 224 before being diverted through the apertures of fluid passageways 230 where it will encounter the heat transfer enhancement features or triangular projections/protuberances 235 which also creates turbulence within the fluid stream and a more tortuous fluid flow path through the heat transfer surface 210. The high pressure drop (HPD) direction is illustrated schematically in FIG. 18 by directional arrow and/or transverse axis 233.

When a fluid (i.e. gas or liquid) flows through the heat transfer surface 210, the sharp edges of the triangular-shaped heat transfer enhancement features 235 may introduce vortices into the fluid contacting or impinging of each heat transfer enhancement features of triangular projection/protuberance 235, which vortices are formed along the inner surface of the plates 213, 215 and help to prevent the flow from separating from the inner surface as the fluid travels through the heat transfer surface or channel 210. In addition to the vortices introduced by the heat transfer enhancement features or triangular projections/protuberances 235, turbulence is also created within the fluid flowing through the heat transfer surface 210 as the fluid impinges on the leading edges 232 of each offset row 214 of corrugations 216 which causes the fluid to divert through the offset apertures or fluid passageways 230 creating a more circuitous or tortuous path through the heat transfer surface 210.

In some embodiments, for example, the heat transfer enhancement features or triangular projections/protuberances 235 are formed directly on the inner surfaces of the spaced apart walls of the enclosed fluid flow channels that make up the heat exchanger. In other example embodiments, they are formed on separate insert plates that are disposed within and brazed to the inner surfaces of the spaced apart walls of the enclosed fluid flow channels.

Heat transfer enhancement features or triangular projections/protuberances 235 in combination with the offset rows 214(1), 214(2) of corrugations 216 of the corrugated member 212 have been found to increase overall heat transfer performance of the heat transfer surface 210 when disposed within an enclosed fluid flow channel of a heat exchanger, as illustrated in the attached graphical representations of overall performance data shown in FIGS. 14 and 15, wherein the subject heat transfer surface 210 is identified as the "delta epsilon" heat transfer surface and shows improved performance over other heat transfer surface structures.

Figure 21:
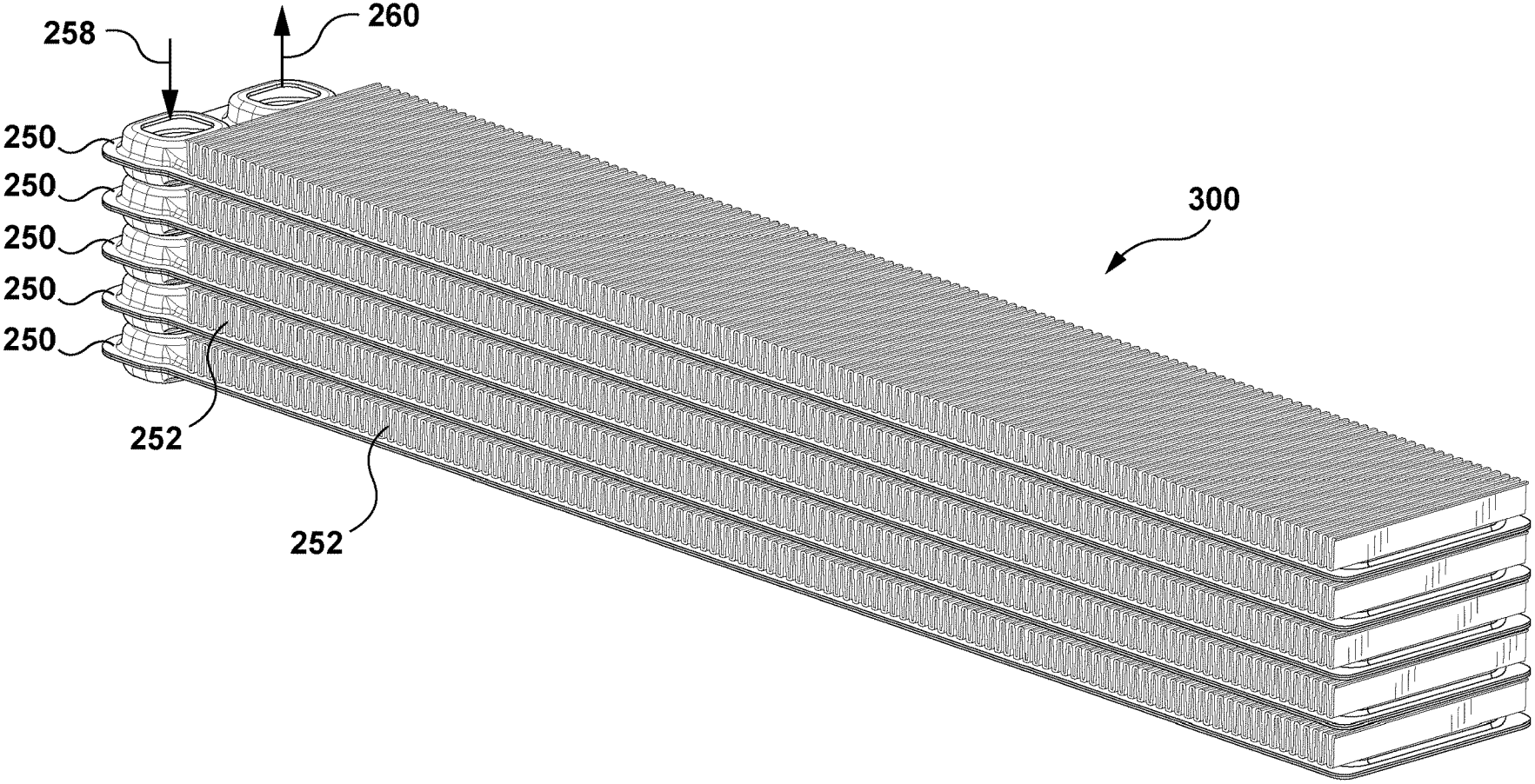
FIG. 21 is a perspective view of an example heat exchanger incorporating a heat transfer surface according to the example embodiments of the present disclosure.

Referring now to FIG. 21, in some example embodiments, when in use, the heat transfer surface 10, 100, 210 of any of the example embodiments described above, is incorporated into the enclosed fluid channels of a heat exchanger 300, for instance, a transmission oil cooler (TOC) with the heat transfer surface 10, 100, 210 serving to improve overall performance of the heat exchanger although it will be understood that the heat transfer surface 10 may be incorporated in any one of a number of heat exchangers and is not intended to be limited to use in a transmission oil cooler.

In accordance with principles known in the art, the heat exchanger 300 includes a plurality of stacked tubular members 250 that extend in spaced apart, parallel or substantially parallel relationship to one another. The plurality of stacked tubular members 250 together defines a first set of fluid channels extending therethrough for the flow of a first fluid through the heat exchanger 300. A second set of fluid passages 252 is defined between adjacent tubular members 250 for the flow of a second fluid, such as air, through the heat exchanger 300. In the example embodiment shown in FIG. 21, tubular members 250 are formed by a pair of mating upper and lower plates 254, 256 and, therefore, may also be referred to as plate pairs. It will be understood, however, that tubular members 250 may also be formed as a one-piece tubular member and that the present disclosure is not intended to be limited to tubular members 250 formed as plate pairs 254, 256.

The plurality of tubular members 250 define an inlet manifold 258 and an outlet manifold 260 for the inletting and discharging of a first heat exchange fluid into and out of the heat exchanger 300. The inlet manifold 258 and outlet manifold 260 fluidly interconnect the set of fluid channels defined by the enclosed tubular members 250.

In some example embodiments, the upper and lower (or first and second) plates 254, 256 have inner surfaces that include the heat transfer enhancements features 235 in the form of triangular shaped protuberances as described above in connection with FIGS. 18-19. Therefore, in some embodiments, the upper and lower (or first and second) plates 254, 256 correspond to the first and second plates 213, 215 that cooperate with corrugated member 212. Therefore, in some embodiments the heat transfer enhancement features 235 are disposed in a predetermined pattern so as to co-operate with corrugated member 212 disposed within the tubular members 250. When disposed within tubular members 50, the upper and lower bridge portions 220, 222 of the corrugated member 12 contact, or substantially contact, the inner surfaces of plates 254, 256.

In other example embodiments, the heat transfer surface 210 is of unitary, one-piece construction formed using additive manufacturing techniques and is disposed within the fluid channels defined within tubular members 250, the outer surfaces of first and second plates 213, 215 contacting, or substantially contacting, the inner surfaces of upper and lower plates 254, 256.

In other example embodiments, the heat transfer surface 210 is not in the form of a unitary one-piece construction and first and second plates 213, 215 are in the form of inserts that are disposed within the fluid channels formed within the tubular members 250 with the corrugated member 212 being disposed within the tubular members 250 between the inserts 213, 215 that include the heat transfer enhancement features 235.

While various example embodiments have been described, it will be understood that certain adaptations and modifications of the described embodiments can be made. Therefore, the above discussed embodiments are considered to be illustrative and not restrictive.

What is claimed is:

1. A heat transfer surface, comprising:

a plurality of transverse rows of corrugations disposed adjacent to one another and extending in an axial direction;

wherein each row includes:

a plurality of spaced apart upper and lower bridge portions; and a plurality of fin surface portions extending between and interconnecting the spaced apart upper and lower bridge portions;

wherein the plurality of spaced apart upper and lower bridge portions and the plurality of fin surface portions are co-operatively configured such that an alternating series of upper and lower bridge portions interconnected by fin surface portions is formed;

the plurality of rows of corrugations includes a plurality of first rows of corrugations and a plurality of second rows of corrugations, wherein the plurality of first rows of corrugations and the plurality of second rows of corrugations are disposed in an alternating series such that one of the plurality of second rows of corrugations is disposed intermediate adjacent ones of the plurality of first rows of corrugations such that the plurality of rows of corrugations that define the heat transfer surface is comprised of a plurality of adjacent sets of first and second rows of corrugations, each set comprising one of the plurality of first rows of corrugations and one of the plurality of second rows of corrugations;

for each set of adjacent first and second rows of corrugations, the first row is offset relative to the adjacent second row such that there is an absence of alignment between a central axis that extends through the upper bridge portion of a corrugation of the first row with a central axis that extends through the upper bridge portion of an adjacent corrugation of the second row such that the central axis of the adjacent corrugation of the second row is displaced laterally, relative to the central axis of the upper bridge portion of the corrugation of the first row by a predetermined distance as measured along an axis that extends transverse to the axial direction of the heat transfer surface;

wherein at least one row of the first row and the second row of each set of adjacent first and second rows includes a heat transfer enhancement feature disposed in the fin surface portions of each of the corrugations defined by the at least one row such that the heat transfer enhancement feature is disposed intermediate adjacent upper and lower bridge portions in the alternating series of upper and lower bridge portions of the at least one row.

2. The heat transfer surface as claimed in claim 1, wherein the predetermined distance by which the central axis of the upper bridge portion of a corrugation in the second row is displaced relative to the the central axis of the upper bridge portion of the corrugation in the first row is 50% of a distance, as measured along the transverse axis, that is spanned by an individual corrugation.

3. The heat transfer surface as claimed in claim 1, wherein the heat transfer enhancement feature comprises:

a ridge portion extending from the fin surface portion such that the fin surface portions are non-planar.

4. The heat transfer surface as claimed in claim 3, wherein the ridge portion is disposed at an angle relative to the attached upper bridge portion.

5. The heat transfer surface as claimed in claim 3, wherein only the plurality of second rows of corrugations includes the ridge portions.

6. The heat transfer surface as claimed in claim 3, wherein the plurality of first rows of corrugations and the plurality of second rows of corrugations each include the ridge portions.

7. The heat transfer surface as claimed in claim 1, wherein the heat transfer enhancement feature comprises:

a plurality of apertures defined in each of the first surface portions of each corrugation in the plurality of first rows of corrugations and the plurality of second rows of corrugations.

8. The heat transfer surface as claimed in claim 7, wherein each row of corrugations in the plurality of rows of corrugations is configured such that the corrugations define a pitch, (P), between a minimum of 2.5 mm to a maximum of 8 mm; and each row of corrugations in the plurality of rows of corrugations has a width, (W), as measured along an axis that extends parallel to the axial direction of the heat transfer surface of a minimum of 1.016 mm to a maximum of 20 mm; and wherein the plurality of apertures are generally circular apertures each having a diameter of a minimum of 0.25 mm to a maximum of 2 mm.

9. The heat transfer surface as claimed in claim 1, wherein the plurality of rows of corrugations further comprise a plurality of third rows of corrugations wherein the each third row is disposed in conjunction with the plurality of first rows and the plurality of second rows such that a repeating pattern of first, second and third rows that extends in the axial direction is defined, wherein each set of corrugations comprises a first row, an adjacent second row, and an adjacent third row;

wherein the first row, the second row and the third row are cooperatively configured such that the third row of corrugations is offset relative to both the first row and the second row such that a central axis extending through the upper bridge portion of a corrugation in the third row is laterally displaced relative to the central axis that extends through the upper bridge portion of the corrugation of the second row by a predetermined distance as measured along the axis that extends transverse to the axial direction of the heat transfer surface.

10. A heat transfer surface, comprising:

a plurality of transverse rows of corrugations disposed adjacent to one another and extending in an axial direction;

wherein each row of corrugations includes:

a plurality of spaced apart upper and lower bridge portions; and a plurality of fin surface portions extending between and interconnecting the spaced apart upper and lower bridge portions;

wherein the plurality of spaced apart upper and lower bridge portions and the plurality of fin surface portions are co-operatively configured such that an alternating series of upper and lower bridge portions interconnected by fin surface portions is formed;

the plurality of rows of corrugations includes a plurality of sets of adjacent rows of corrugations, each set of adjacent rows corrugations comprising a first row, a second row and a third row;

wherein for each set of adjacent rows of corrugations, the first row is offset relative to the second row such that there is an absence of alignment between a central axis that extends through an upper bridge portion of a corrugation defined by the second row with a central axis that extends through an upper bridge portion of a corrugation defined by the adjacent first row such that the central axis that extends through the upper bridge portion of the corrugation defined by the second row is laterally displaced relative to the central axis that extends through the upper bridge portion of the corrugation defined by the first row, by a predetermined distance, as measured along an axis that extends transverse to the axial direction of the heat transfer surface, and the third row is offset relative to the second row such that there is an absence of alignment between a central axis that extend through an upper bridge portion of a corrugation defined by the third row with the central axis that extends through the upper bridge portion of the corrugation defined by the second row such that the central axis that extends through the upper bridge portion of the corrugation defined by the third row is laterally displaced laterally relative to the central axis of the corrugation defined by the second row along the axis that extends transverse to the axial direction of the heat transfer surface;

wherein:

the plurality of sets of adjacent rows of corrugations are disposed in series such that the heat transfer surface is comprised of a repeating pattern of first, second and third rows of corrugations; and each row of corrugations in the repeating pattern of the first, second and third rows of corrugations includes a heat transfer enhancement feature disposed in the fin surface portions of the corrugations of each of the rows of corrugations such that the heat transfer enhancement feature is disposed intermediate adjacent upper and lower bridge portions in the alternating series of upper and lower bridge portions defined by each row of the corrugations.

11. The heat transfer surface as claimed in claim 10, wherein:

the predetermined distance by which the central axis that extends through the upper bridge portion of the corrugation in the second row is displaced relative to the central axis that extends through the upper bridge portion of the corrugation in the first row, and the predetermined distance by which the central axis that extends through the upper bridge portion of the corrugation in the third row is displaced relative to the central axis that extends through the upper bridge portion of the corrugation in the second row are each, independently, between a minimum of 23% to a maximum of 33% of a distance, as measured along the transverse axis, that is spanned by an individual corrugation.

12. The heat transfer enhancement feature as claimed in claim 10, wherein the heat transfer enhancement feature comprises one of the following alternatives:

a ridge portion extending from the fin surface portion; or a plurality of apertures defined in each of the first surface portions of each corrugation in the plurality of first rows of corrugations, the plurality of second rows of corrugations and the plurality of third row of corrugations.

13. A heat transfer surface, comprising:

a pair of first and second spaced apart plates each plate defining an inner surface;

a corrugated member disposed between the spaced apart first and second plates, the corrugated member including a plurality of transverse rows of corrugations disposed adjacent to one another and extending in an axial direction;

wherein each row includes:

a plurality of spaced apart upper and lower bridge portions; and a plurality of fin surface portions extending between and interconnecting the spaced apart upper and lower bridge portions;

wherein the plurality of spaced apart upper and lower bridge portions and the plurality of fin surface portions are co-operatively configured such that an alternating series of upper and lower bridge portions interconnected by fin surface portions is formed defining a plurality of heat transfer enhancement-receiving spaces;

the plurality of rows of corrugations includes at least a first row of corrugations and at least a second row of corrugations disposed in series in the axial direction such that the at least a first row and the at least a second row, together, define a pair of adjacent rows of corrugations;

for each pair of adjacent first and second rows of corrugations, the first row is offset relative to the second row such that there is an absence of alignment between central axis that extends through an upper bridge portion of a corrugation defined by the second row with a central axis that extends through an upper bridge portion of a corrugation defined by the first row, the central axis of the corrugation defined by the second row being laterally displaced relative to the central axis that extends through the upper bridge portion of the corrugation defined by the first by a predetermined distance as measured along an axis that extends transverse to the axial direction of the corrugated member;

a plurality of heat transfer enhancement features disposed on the inner surfaces of the first and second spaced apart plates such that one of the plurality of heat transfer enhancement features is disposed in each heat transfer enhancement-receiving spaced defined by the alternating series of upper and lower bridge portions interconnected by fin surface portions of each row of corrugations of the corrugated member.

14. The heat transfer surface as claimed in claim 13, wherein a plurality of pairs of first and second rows are disposed in series such that the corrugated member is defined by a plurality of first rows and a plurality of second rows disposed in an alternating series of first rows and second rows that extends in the axial direction.

15. The heat transfer surface as claimed in claim 13, wherein the predetermined distance by which the central axis that extends through the upper bridge portion of the corrugation in the second row is laterally displaced relative to the central axis that extends through the upper bridge portion of the corrugation defined by the first row is 50% of a distance, as measured along the transverse axis, that is spanned by an individual corrugation.

16. The heat transfer surface as claimed claim 13, wherein the heat transfer enhancement features each comprise:

a triangular-shaped protuberance having a tip and a base, wherein the tip protrudes from the inner surface of the first or second plate; and wherein the tips of the triangular-shaped protuberances disposed on the inner surface of the first plate are oriented towards the tips of the triangular-shaped protuberances disposed on the inner surface of the second plate.

* * * * *